US008267499B2

(12) United States Patent
Ueno

(10) Patent No.: US 8,267,499 B2
(45) Date of Patent: Sep. 18, 2012

(54) HEAD CAP HAVING AIR COMMUNICATING CHANNEL, AND LIQUID DROPLETS EJECTION HEAD RECOVERING MECHANISM AND LIQUID DROPLETS EJECTION PRINTER THEREFOR

(75) Inventor: Takashi Ueno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 123 days.

(21) Appl. No.: 12/542,782

(22) Filed: Aug. 18, 2009

(65) Prior Publication Data

US 2010/0079538 A1 Apr. 1, 2010

(30) Foreign Application Priority Data

Sep. 30, 2008 (JP) ..... 2008-254766

(51) Int. Cl.
*B41J 2/165* (2006.01)
*B41J 2/155* (2006.01)

(52) U.S. Cl. ..... 347/29; 347/42

(58) Field of Classification Search ..... 347/29
See application file for complete search history.

(56) References Cited

U.S. PATENT DOCUMENTS 5,027,134 A * 6/1991 Harmon et al. ..... 347/29
5,216,449 A * 6/1993 English ..... 347/29
5,712,668 A 1/1998 Osborne et al.
5,805,181 A * 9/1998 Tanaka et al. ..... 347/29
5,867,184 A * 2/1999 Quintana ..... 347/29
5,956,053 A * 9/1999 Michael ..... 347/29
6,209,983 B1 * 4/2001 Osborne et al. ..... 347/29
6,220,689 B1 * 4/2001 Sturgeon ..... 347/29
6,406,123 B1 * 6/2002 Usui et al. ..... 347/29
(Continued)

FOREIGN PATENT DOCUMENTS

JP H08-230200 A 9/1996
(Continued)

OTHER PUBLICATIONS

Japan Patent Office; Notification of Reason for Refusal in Japanese Patent Application No. 2008-254766 (counterpart to the above-captioned US Patent Application) mailed on Jul. 27, 2010.

*Primary Examiner* — Shelby Fidler
(74) *Attorney, Agent, or Firm* — Baker Botts L.L.P.

(57) ABSTRACT

A head cap, including: a cap including (a) a bottom plate portion and (b) a projecting portion which functions as a side wall, which extends from the bottom plate portion so as to define a recessed portion with the bottom plate portion, and whose distal end contacts with a surrounding of a liquid-droplets ejecting area formed in a liquid-droplets ejecting surface of a liquid-droplets ejecting head so as to enclose the liquid-droplets ejecting area; a holder configured to support the cap; a groove formed in at least one of a first surface of the bottom plate portion which is opposed to the holder and a second surface of the holder which is opposed to the bottom plate portion so as to partly constitute an air communicating channel that communicates the recessed portion and an outside with each other; and a channel wall provided between the first surface and the second surface so as to enclose the groove as seen in a direction perpendicular to one of the first surface and the second surface by contacting with at least one of the first surface and the second surface.

20 Claims, 12 Drawing Sheets

U.S. PATENT DOCUMENTS

| | | | | |
|---|---|---|---|---|
| 6,517,185 | B1 * | 2/2003 | Aldrich | 347/29 |
| 2003/0137553 | A1 * | 7/2003 | Harper | 347/29 |
| 2004/0008236 | A1 * | 1/2004 | Yun | 347/29 |
| 2004/0246295 | A1 * | 12/2004 | Aldrich et al. | 347/29 |
| 2005/0058265 | A1 * | 3/2005 | Lim | 379/142.01 |
| 2005/0110827 | A1 * | 5/2005 | Aldrich et al. | 347/29 |
| 2007/0257957 | A1 | 11/2007 | Takagi | |

FOREIGN PATENT DOCUMENTS

| | | | |
|---|---|---|---|
| JP | 2000-043281 | A | 2/2000 |
| JP | 2003-089210 | A | 3/2003 |
| JP | 2004-230711 | A | 8/2004 |
| JP | 2007-152813 | A | 6/2007 |
| JP | 2007-268852 | A | 10/2007 |

* cited by examiner

HEAD CAP HAVING AIR COMMUNICATING CHANNEL, AND LIQUID DROPLETS EJECTION HEAD RECOVERING MECHANISM AND LIQUID DROPLETS EJECTION PRINTER THEREFOR

CROSS REFERENCE TO RELATED APPLICATION

The present application claims priority from Japanese Patent Application No. 2008-254766, which was filed on Sep. 30, 2008, the disclosure of which is herein incorporated by reference in its entirety.

BACKGROUND OF THE INVENTION

1. Field of the Invention

The present invention relates to a head cap which covers or caps an ink-ejection surface of a liquid-droplets ejection head configured to eject liquid droplets, a liquid-droplets-ejection-head recovering mechanism for recovering a liquid-droplets-ejection property of the liquid-droplets ejection head, and a liquid-droplets ejection printer including the liquid-droplets ejection head.

2. Description of the Related Art

In an ink-jet printer, there is known a technique that an ink-ejection surface of a head is sealed by a cap when recording is not performed, thereby preventing drying of nozzles opened in the ink-ejection surface. Where the ink-ejection surface is sealed by the cap, when the printer or only a head thereof is stored for a relatively long time or transported by, e.g., aircraft, a pressure difference between an inside of the cap and air may become relatively large by a pressure fluctuation of ambient atmosphere, and thus a liquid such as an ink and a storage liquid may leak from the nozzles. In order to prevent this, there is proposed, in Patent Document 1 (Japanese Patent Application Publication No. 2003-089210), to form an air communication channel having an appropriate resistance (channel resistance) to a flow of the air in the channel in order to communicate the inside of the cap and the air and to prevent the nozzles from drying.

In this air communicating channel, in accordance with decrease in the channel resistance thereof, an effect for preventing the drying of the nozzles by the cap is reduced. In the above-described air communicating channel, a length thereof is secured for obtaining the channel resistance. For example, in Patent Document 1, an air-communication groove extending while bending is formed in an upper surface of a cap holder holding the cap, and a back surface of the cap formed by a rubber elastic body and the upper surface of the cap holder closely contact with each other by a pressure during capping, thereby forming the air communicating channel.

SUMMARY OF THE INVENTION

According to this technique, the air communicating channel can be formed by a simple operation in which the cap is disposed on the cap holder. However, where the inkjet head is upsized, since a size and a dimension of the air-communication groove are changed due to an uneven distribution of a pressure in capping, a desired channel resistance cannot be obtained. Further, the back surface of the cap and the upper surface of the cap holder cannot closely contact with each other evenly, and thus the air-communication groove may not be formed as desired. Where the air-communication groove is not formed, the channel resistance of the air communicating channel extremely decreases, thereby reducing the effect for preventing the drying of the nozzles by the cap.

This invention has been developed in view of the above-described situations, and it is an object of the present invention to provide a head cap, a liquid-droplets-ejection-head recovering mechanism, and a liquid-droplets ejection printer which can reliably communicate an inside of the cap and an outside at a predetermined channel resistance.

The object indicated above may be achieved according to the present invention which provides a head cap, comprising: a cap including (a) a bottom plate portion and (b) a projecting portion which functions as a side wall, which extends from the bottom plate portion so as to define a recessed portion with the bottom plate portion, and whose distal end contacts with a surrounding of a liquid-droplets ejecting area formed in a liquid-droplets ejecting surface of a liquid-droplets ejecting head so as to enclose the liquid-droplets ejecting area; a holder configured to support the cap; a groove formed in at least one of a first surface of the bottom plate portion which is opposed to the holder and a second surface of the holder which is opposed to the bottom plate portion so as to partly constitute an air communicating channel that communicates the recessed portion and an outside with each other; and a channel wall provided between the first surface and the second surface so as to enclose the groove as seen in a direction perpendicular to one of the first surface and the second surface by contacting with at least one of the first surface and the second surface.

The object indicated above may also be achieved according to the present invention which provides a head cap, comprising: a cap having a rectangular shape in plan view and including (a) a bottom plate portion and (b) a circular lip portion which functions as a side wall, which is provided upright on the bottom plate portion so as to define a recessed portion with the bottom plate portion, and whose distal end contacts with a surrounding of a nozzle surface of an ink-jet head so as to enclose a plurality of nozzles formed in the nozzle surface when contacting with the nozzle surface; a holder configured to support the cap; a pair of wall bodies which extend in a longitudinal direction of the cap while being interposed between the bottom plate portion and the holder in one of side end portions of the cap in a widthwise direction thereof and which are formed on the bottom plate portion so as to be superposed on the lip portion in plan view; a pair of dummy wall bodies which extend in the longitudinal direction of the cap while being interposed between the bottom plate portion and the holder in the other of the side end portions of the cap in the widthwise direction thereof and which are formed on the bottom plate portion so as to be superposed on the lip portion in plan view; a groove which extends while being interposed between the pair of wall bodies and communicates the recessed portion and an outside with each other via a through hole formed in the bottom plate portion; and a connecting portion configured to connect the pair of wall bodies to each other, wherein the groove is formed in the bottom plate portion and an entire perimeter of the groove is enclosed with the pair of wall bodies and the connecting portion in plan view.

The object indicated above may also be achieved according to the present invention which provides a liquid-droplets-ejection-head recovering mechanism configured to perform a recovering operation for recovering a liquid-droplets-ejection property of a liquid-droplets ejection head, the mechanism comprising: a head cap which contacts with a liquid-droplets ejecting surface of the liquid-droplets ejection head such that a liquid-droplets ejecting area of the liquid-droplets ejecting head is covered by the head cap; a raising and lowering mechanism configured to move the head cap relative to the liquid-droplets ejecting head between a contact position at which the head cap contacts with the liquid-droplets ejecting surface and a distant position distant from the liquid-droplets ejecting surface in a vertical direction; and a moving mechanism configured to move the head cap relative to the liquid-droplets ejecting head between an opposed position opposed to the liquid-droplets ejecting head and a retracted position distant from the opposed position in a direction intersecting the vertical direction, wherein the head cap includes: a cap including (a) a bottom plate portion and (b) a projecting portion which functions as a side wall, which extends from the bottom plate portion so as to define a recessed portion with the bottom plate portion, and whose distal end contacts with a surrounding of the liquid-droplets ejecting area so as to enclose the liquid-droplets ejecting area; a holder configured to support the cap; a pair of wall bodies disposed so as to extend in an area opposed to the projecting portion while being interposed between the bottom plate portion and the holder; a groove extending while being interposed between the pair of wall bodies so as to constitute an air communicating channel that communicates the recessed portion and an outside with each other; a connecting portion configured to connect the pair of wall bodies to each other, and wherein the groove is formed in at least one of a first surface of the bottom plate portion and a second surface of the holder, and is enclosed with the pair of wall bodies and the connecting portion as seen in a direction perpendicular to one of the first surface and the second surface.

The object indicated above may also be achieved according to the present invention which provides a liquid-droplets ejection printer comprising: a sheet feeding mechanism configured to feed a recording medium in a sheet feeding direction; a liquid-droplets ejecting head having a liquid-droplets ejecting surface in which a liquid-droplets ejecting area for ejecting a liquid is formed and configured to form an image on the recording medium fed by the sheet feeding mechanism; and a recovering mechanism configured to perform a recovering operation for recovering a liquid-droplets-ejection property of the liquid-droplets ejection head, the mechanism including: a head cap which contacts with the liquid-droplets ejecting surface such that the liquid-droplets ejecting area is enclosed by the head cap; a raising and lowering mechanism configured to move the head cap relative to the liquid-droplets ejecting head between a contact position at which the head cap contacts with the liquid-droplets ejecting surface and a distant position distant from the liquid-droplets ejecting surface in a vertical direction; and a moving mechanism configured to move the head cap relative to the liquid-droplets ejecting head between an opposed position opposed to the liquid-droplets ejecting head and a retracted position distant from the opposed position in a direction intersecting the vertical direction, wherein the head cap includes: a cap including (a) a bottom plate portion and (b) a projecting portion which functions as a side wall, which extends from the bottom plate portion so as to define a recessed portion with the bottom plate portion, and whose distal end contacts with a surrounding of the liquid-droplets ejecting area so as to enclose the liquid-droplets ejecting area; a holder configured to support the cap; a pair of wall bodies disposed so as to extend in an area opposed to the projecting portion while being interposed between the bottom plate portion and the holder; a groove extending while being interposed between the pair of wall bodies so as to constitute an air communicating channel that communicates the recessed portion and an outside with each other; a connecting portion configured to connect the pair of wall bodies to each other, and wherein the groove is formed in at least one of a first surface of the bottom plate portion and a second surface of the holder, and is enclosed with the pair of wall bodies and the connecting portion as seen in a direction perpendicular to one of the first surface and the second surface.

In the head cap constructed as described above, the distal end of the projecting portion is pressed to the liquid-droplets ejecting surface of the liquid-droplets ejecting head, whereby the channel wall provided between the first surface of the bottom plate portion and the second surface of the holder is pressed to the at least one of the first surface and the second surface at a relatively high pressure. As a result, the channel wall closely contacts with at least one of the bottom plate portion and the holder, so that the communicating channel partly constituted by the groove is reliably formed. Thus, the recessed portion in the cap and the outside can be reliably communicated with each other at a predetermined channel resistance.

Further, from another viewpoint, in the head cap constructed as described above, the lip portion is pressed to the nozzle surface, whereby the wall bodies formed so as to be superposed on the lip portion are pressed to the holder at a relatively high pressure. As a result, the wall bodies closely contact with the holder, so that the communicating channel partly constituted by the groove is reliably formed. Thus, the recessed portion in the cap and the outside can be reliably communicated with each other at a predetermined channel resistance. Further, the pair of the dummy wall bodies are formed on the bottom plate portion, thereby preventing the cap from inclining relative to the holder. Thus, the recessed portion in the cap and the outside can be reliably communicated with each other at the predetermined channel resistance.

Further, in the liquid-droplets-ejection-head recovering mechanism constructed as described above, the distal end of the projecting portion is pressed to the liquid-droplets ejecting surface of the liquid-droplets ejecting head, whereby the wall bodies provided between the bottom plate portion and the holder are pressed to the at least one of the bottom plate portion and the holder at a relatively high pressure. As a result, there can be realized the liquid-droplets-ejection-head recovering mechanism in which the wall bodies closely contact with at least one of the bottom plate portion and the holder, and thus the communicating channel partly constituted by the groove is reliably formed, whereby the recessed portion in the cap and the outside can be reliably communicated with each other at a predetermined channel resistance.

Further, in the liquid-droplets ejection printer constructed as described above, the distal end of the projecting portion is pressed to the liquid-droplets ejecting surface of the liquid-droplets ejecting head, whereby the wall bodies provided between the bottom plate portion and the holder are pressed to the at least one of the bottom plate portion and the holder at a relatively high pressure. As a result, there can be realized the liquid-droplets ejection printer in which the wall bodies closely contact with at least one of the bottom plate portion and the holder, and thus the communicating channel partly constituted by the groove is reliably formed, whereby the recessed portion in the cap and the outside can be reliably communicated with each other at a predetermined channel resistance.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENTS

Hereinafter, there will be described a preferred embodiment of the present invention by reference to the drawings.

Figure 1:
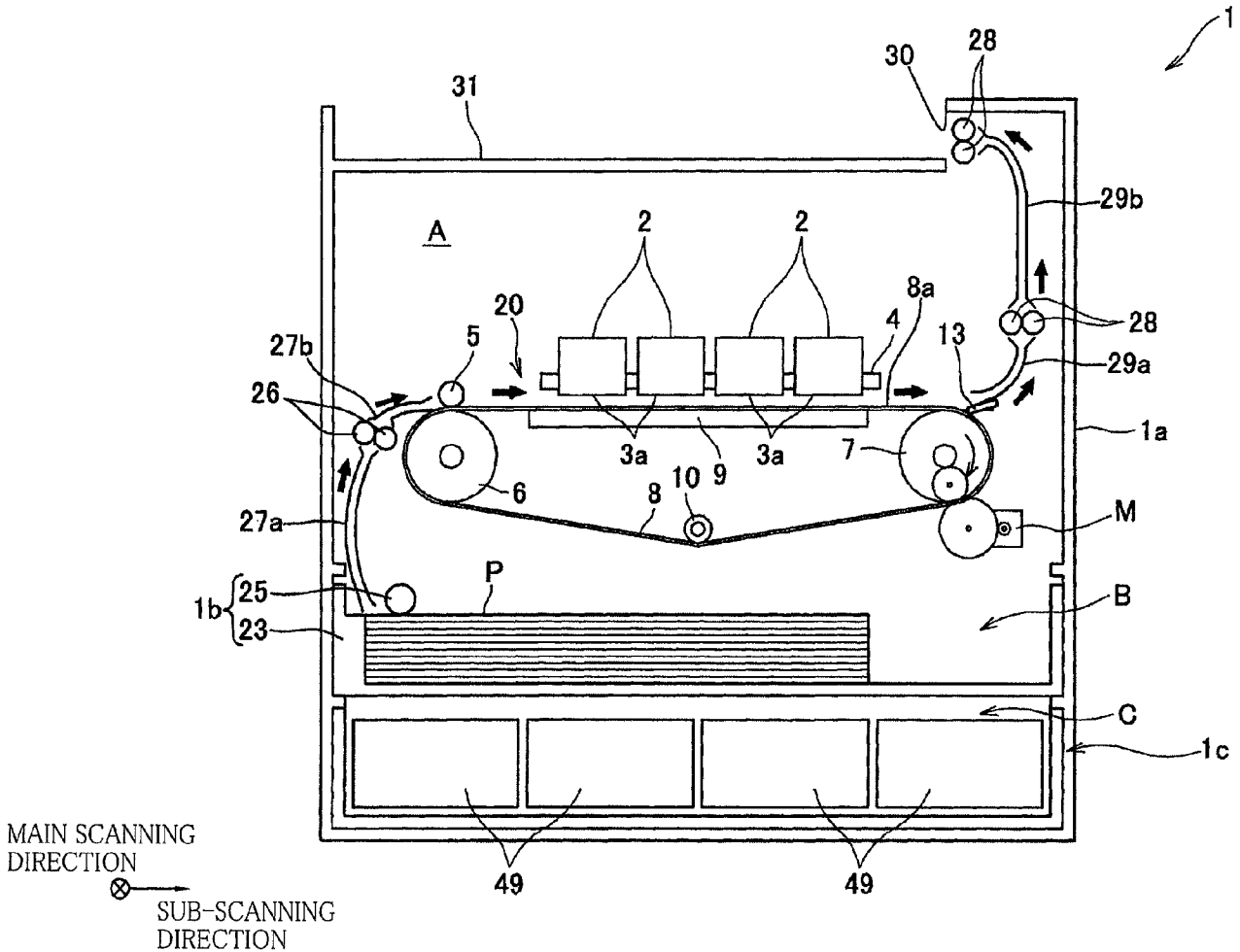
FIG. 1 is a side elevational view in cross section generally showing an ink-jet printer as an embodiment of the present invention.
Figure 2:
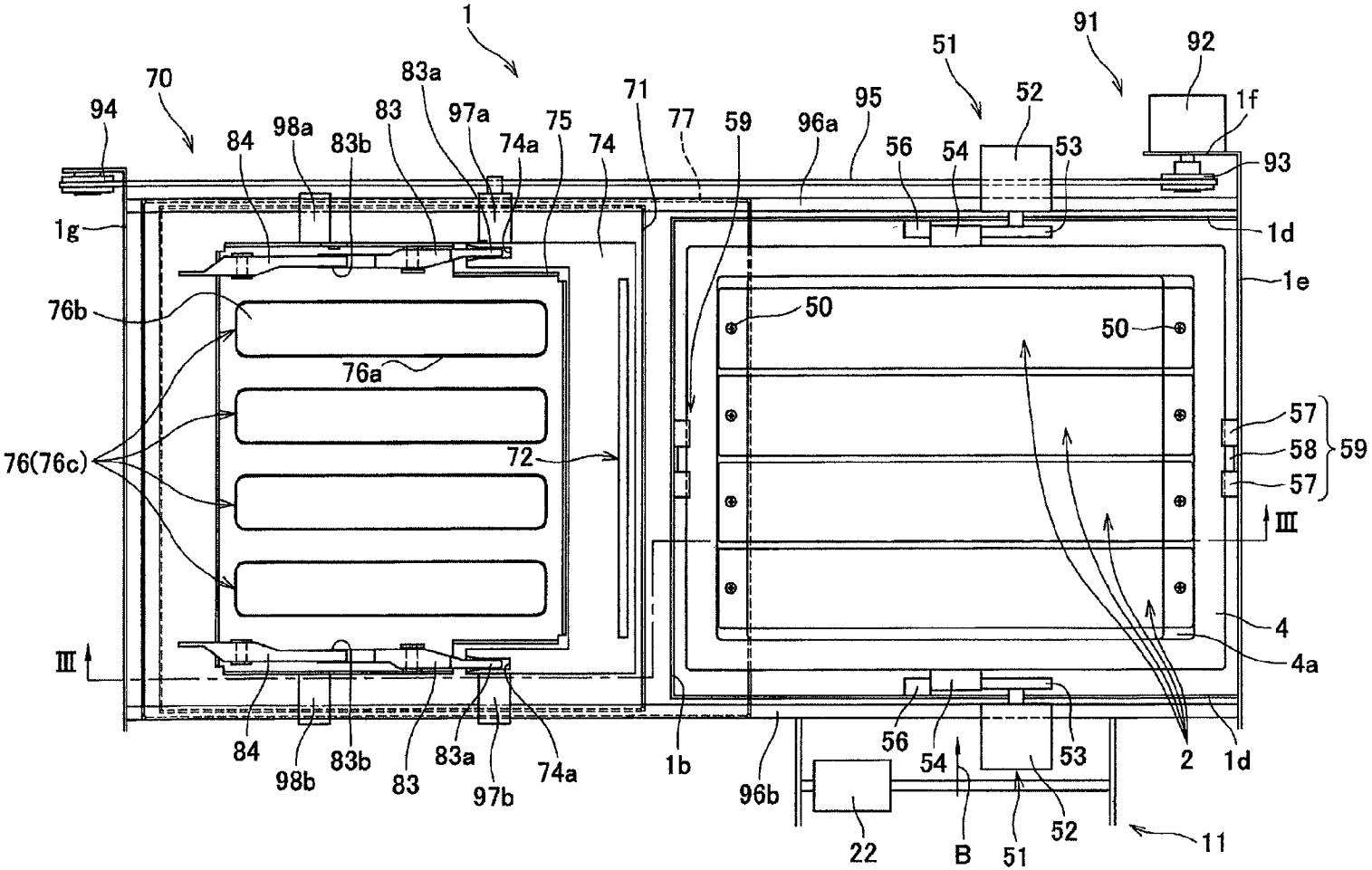
FIG. 2 is a plan view generally showing a main portion of the ink-jet printer shown in FIG. 1.
Figure 3:
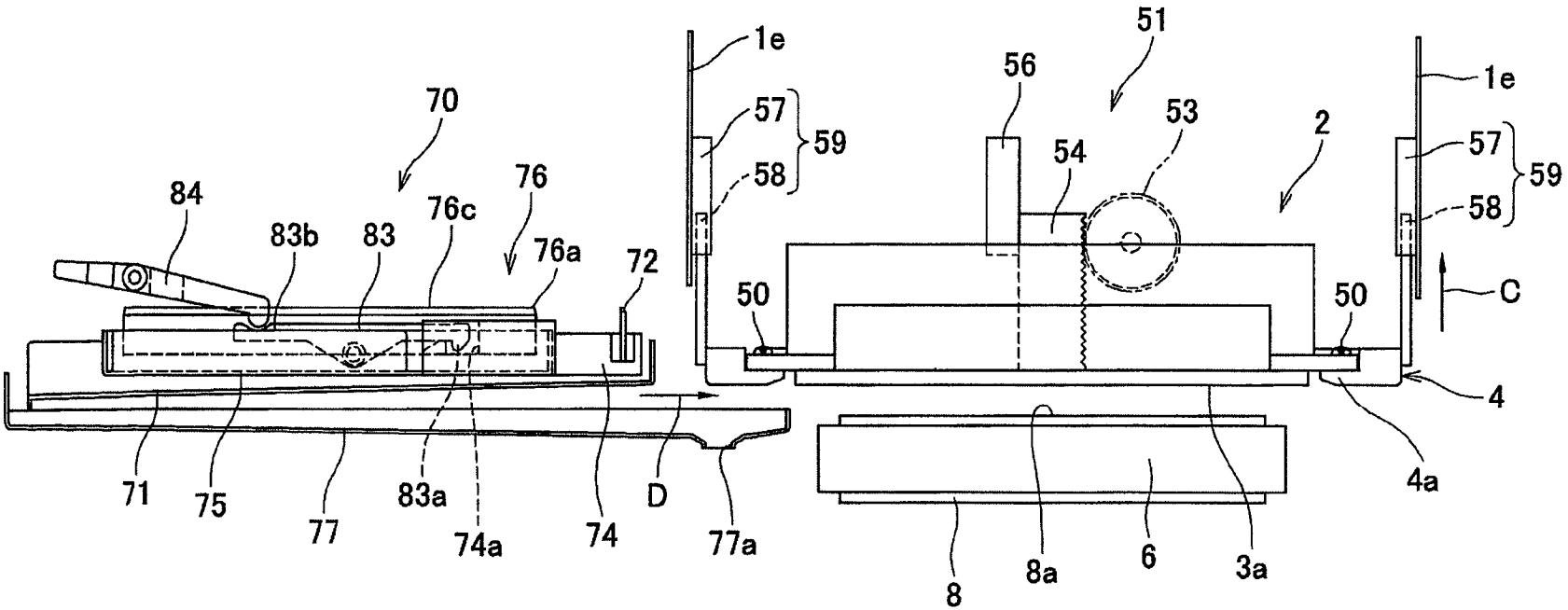
FIG. 3 is a cross-sectional view taken along line III-III of FIG. 2.

As shown in FIGS. 1-3, an ink-jet printer 1 includes a body 1*a* having a rectangular parallelepiped shape. A sheet-discharge portion 31 is provided at an upper portion of the body 1*a*. Further, an inside of the body 1*a* is separated into three spaces A, B, C in order from above. In the space A, there are disposed four ink-jet heads (i.e., liquid-droplets ejecting heads) 2 which respectively eject inks of four colors, namely, magenta, cyan, yellow, and black, a sheet-feed unit (i.e., a sheet feeding direction) 20, and a maintenance unit 70 (on a back side of the sheet-feed unit 20 in FIG. 1). The spaces B, C are spaces in which a sheet-supply unit 1*b* and an ink tank unit 1*c* attachable and detachable to and from the body 1*a* are respectively disposed. It is noted that, in the present embodiment, a sub-scanning direction is a direction parallel to a sheet feeding direction in which each sheet P is fed by the sheet-feed unit 20 while a main scanning direction is a direction perpendicular to the sub-scanning direction and along a horizontal surface.

In the ink-jet printer 1, there is formed a sheet feeding path (indicated by boldface arrow in FIG. 1) in which each sheet P is fed from the sheet-supply unit 1*b* to the sheet-discharge portion 31. The sheet-supply unit 1*b* includes a sheet-supply tray 23 which can accommodate a plurality of the sheets P, and a sheet-supply roller 25 attached to the sheet-supply tray 23. The sheet-supply roller 25 supplies or feeds an uppermost one of the sheets P stacked on each other and accommodated in the sheet-supply tray 23. The sheet P supplied by the sheet-supply roller 25 is fed to the sheet-feed unit 20 while being guided by guides 27*a*, 27*b* and being nipped between a pair of feed rollers 26.

The sheet-feed unit 20 includes two belt rollers 6, 7, an endless sheet-feed belt 8 wound around the rollers 6, 7 so as to bridge the rollers 6, 7, and a tension roller 10. The tension roller 10 applies tension to the sheet-feed belt 8 by being biased downward while contacting with an inner peripheral surface of the sheet-feed belt 8 at a lower portion of the belt 8. A belt roller 7 is a drive roller rotated in a clockwise direction in FIG. 1 by being given a drive force from a sheet feeding motor M via a plurality of gears. The belt roller 6 is a driven roller rotated in the clockwise direction in FIG. 1 with rotation of the sheet-feed belt 8 by rotation of the belt roller 7.

An outer peripheral surface 8*a* of the sheet-feed belt 8 is subjected to a silicone treatment to have a viscosity. In the sheet feeding path, there is disposed a nipping roller 5 at a position opposite to the belt roller 6 in a state in which the sheet-feed belt 8 is interposed between the nipping roller 5 and the belt roller 6. The nipping roller 5 presses, toward the outer peripheral surface 8*a* of the sheet-feed belt 8, each sheet P supplied by the sheet-supply unit 1*b*. The sheet P pressed toward the outer peripheral surface 8*a* is fed rightward in FIG. 1 while being held by and on the outer peripheral surface 8*a* owing to the viscosity thereof.

A peeling plate 13 is provided at a position opposite to the belt roller 7 in a state in which the sheet-feed belt 8 is interposed between the peeling plate 13 and the belt roller 7. The peeling plate 13 peels, from the outer peripheral surface 8*a*, each sheet P held by the sheet-feed belt 8. The sheet P peeled by the outer peripheral surface 8*a* is fed while being guided by guides 29*a*, 29*b* and being nipped between two pairs of feed rollers 28. Then, the sheet P is discharged to the sheet-discharge portion 31 from an opening 30 formed in an upper portion of the body 1*a*.

Figure 4:
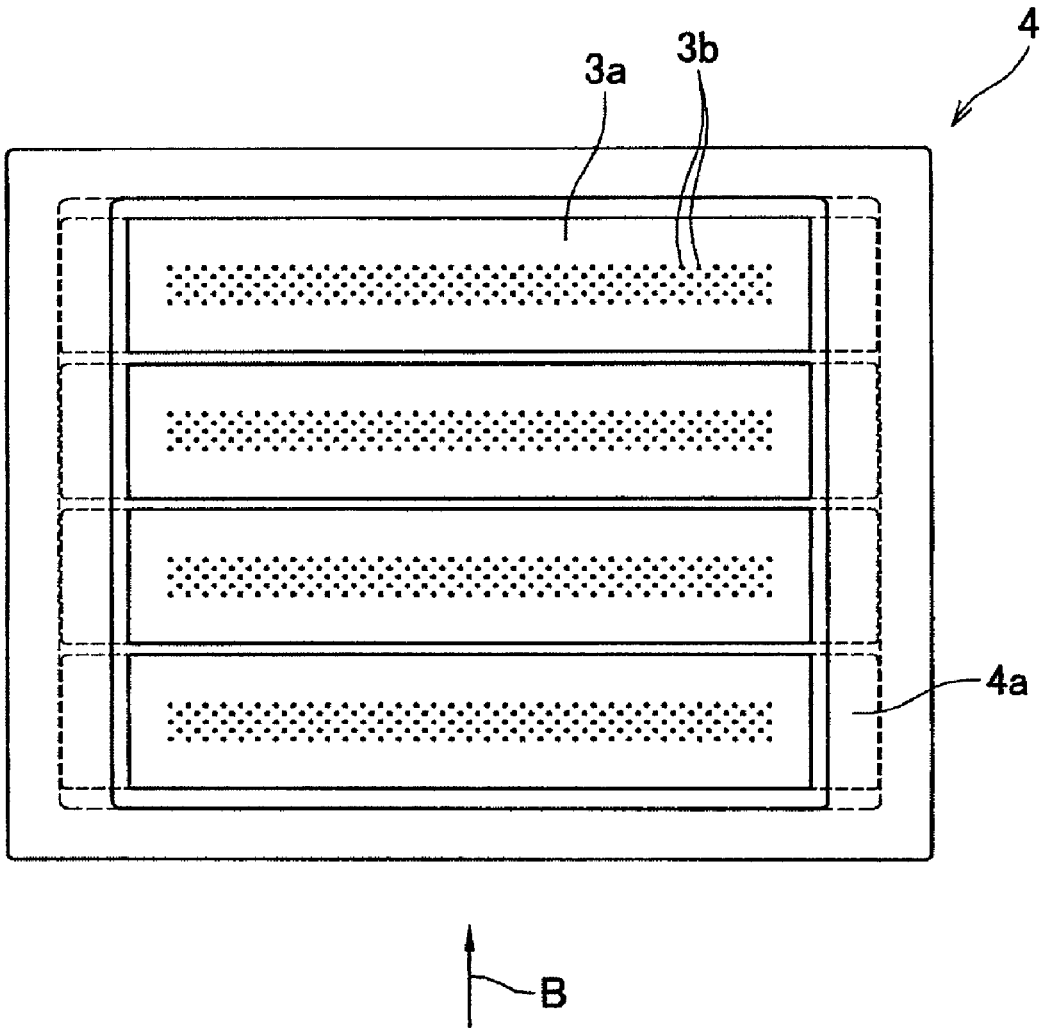
FIG. 4 is a view of four ink-jet heads shown in FIG. 2 as seen from below.

As shown in FIGS. 2-4, each of the four ink-jet heads 2 extends in the main scanning direction and is fixed to a frame 4 in a state in which the heads 2 are arranged adjacent to each other in a sheet feeding direction B. On the frame 4, there are formed supporting portions 4*a* to which the frame 4 is fixed and which are projected to positions respectively facing opposite end portions of a lower surface of the ink-jet head 2 in a longitudinal direction thereof. The supporting portions 4*a* and the respective opposite end portions of the ink-jet head 2 are fixed by screws 50. Further, as shown in FIG. 4, in an ink-ejection surface (i.e., a liquid-droplets ejecting surface) 3*a* of each ink-jet head 2, there are formed a plurality of nozzles 3*b* in the main scanning direction (i.e., the longitudinal direction of the ink-jet head 2). A direction in which the nozzles 3*b* are arranged in rows (i.e., a direction of rows of the nozzles) coincides with a longitudinal direction of caps 76 which will be described below. It is noted that an area of each ink-ejection surface 3*a* in which the nozzles 3*b* are formed functions as an ink-ejection area (i.e., a liquid-droplets ejecting area) of the ink-ejection surface 3*a*. Thus, the ink-jet printer 1 is a color ink-jet printer of a line type in which the ink-ejection area extending in the main scanning direction is formed.

As shown in FIG. 1, a platen 9 is disposed in a loop of the sheet-feed belt 8 so as to be opposed to the four inkjet heads 2. An upper surface of the platen 9 contacts with the inner peripheral surface of the upper portion of the sheet-feed belt 8 and supports the sheet-feed belt 8 from a side of the inner peripheral surface thereof. As a result, the outer peripheral surface 8*a* of the upper portion of the sheet-feed belt 8 and the respective lower surfaces of the ink-jet heads 2, i.e., the respective ink-ejection surfaces 3*a* are opposed and parallel to each other, and a slight space is formed between the ink-ejection surfaces 3*a* and the outer peripheral surface 8*a* of the sheet-feed belt 8. When each sheet P fed by the sheet-feed belt 8 is fed through just below the four ink-jet heads 2, the inks of the respective colors are sequentially ejected onto an upper surface of the sheet P from the ink-jet heads 2, thereby forming a desired color image on the sheet P.

Further, as shown in FIGS. 2 and 3, the frame 4 is supported by frame moving mechanisms 51 (i.e., raising and lowering mechanisms) provided in the ink-jet printer 1 so as to be movable upward and downward. The frame moving mechanisms 51 are disposed on outer sides of the four ink-jet heads 2 so as to interpose the ink-jet heads 2 (that is, the frame moving mechanisms 51 are respectively disposed on an upper side and a lower side in FIG. 2). Each of the frame moving mechanisms 51 includes a drive motor 52, a pinion gear 53, a rack gear 54, and a guide 56. The drive motor 52 functions as a drive source which moves the frame 4 upward and downward. The pinion gear 53 is fixed to a shaft of the drive motor 52. The rack gear 54 is provided and stands on the frame 4 so as to be meshed with the pinion gear 53. The guide 56 is disposed at a position in which the guide 56 interposes the rack gear 54 with the pinion gear 53, that is, the guide 56 is disposed such that the rack gear 54 is interposed between the guide 56 and the pinion gear 53.

The two drive motors 52 are respectively fixed to main body frames 1*d* of the ink-jet printer 1 which are disposed so as to be opposed to each other in the sheet feeding direction B. The two rack gears 54 extend in the vertical direction, and lower end portions thereof are respectively fixed to side faces of the frame 4. Further, a side face of each of the rack gears 54 which is nearer to a corresponding one of the guides 56 slidably contacts with the corresponding guide 56. The guides 56 are respectively fixed to the main body frames 1*d*.

In this configuration, when the two drive motors 52 are synchronized with each other, and the pinion gears 53 are forwardly or reversely rotated, the rack gear 54 are moved upward or downward. In accordance with the upward or downward movement of the rack gears 54, the frame 4 and the four ink-jet heads 2 are moved in the vertical direction.

Further, guide portions 59 are disposed on opposite sides of the ink-jet heads 2 in the longitudinal direction thereof. Each of the guide portions 59 is constituted by a rod member 58 and a pair of guides 57 nipping the rod member 58 therebetween. As shown in FIG. 3, the pair of guides 57 extend in the vertical direction and are respectively fixed to main body frames 1*e* opposed to each other in a direction perpendicular to the sheet feeding direction B. On the other hand, the rod members 58 extend in the vertical direction like the guides 57 and respectively fixed to side faces of the frame 4 which are disposed parallel and opposite to respective side faces of the main body frames 1*e*. Further, the rod member 58 is slidably nipped by and between the pair of guides 57. These guide portions 59 can prevent that the ink-ejection surfaces 3*a* of the respective ink-jet heads 2 are inclined relative to the outer peripheral surface 8*a* when the frame 4 is moved in the vertical direction by the frame moving mechanisms 51.

The frame 4 is normally disposed at a "print position" or a "distant position" (i.e., a position indicated in FIG. 3) at which the inks are ejected to the sheet to perform recording. In a maintenance operation of the ink-jet heads 2 (for example, in a purging operation in which the inks are forced to be ejected from the respective ink-jet heads 2, in a wiping operation for wiping the inks adhering to the ink-ejection surfaces 3*a*, and in a capping operation for covering or capping the ink-ejection surfaces 3*a* with the respective caps), the frame 4 is moved by the frame moving mechanisms 51, thereby being disposed at a "head maintenance position" or a "contact position" located higher than the print position in the vertical direction.

The ink-jet heads 2 are respectively connected to ink tanks 49 in the ink tank unit 1*c* installed in the space C. In the four ink tanks 49, the respective inks ejected from the ink-jet heads 2 are stored. In this ink-jet printer 1, the inks are respectively supplied to the ink-jet heads 2 from the ink tanks 49 via tubes or the like, not shown.

There will be next explained in detail the maintenance unit 70 for performing the maintenance operation of the ink-jet heads 2. As shown in FIGS. 2 and 3, the maintenance unit 70 is disposed in the ink-jet printer 1 on a left side of the ink-jet heads 2 in FIG. 2. The maintenance unit 70 includes trays 71, 75 movable horizontally. The tray 71 has a generally square box-like shape having an opening opened upward and can enclose the tray 75. The tray 71 and the tray 75 are connected to each other by engaging means which will be described below so as to be attached and detached. The trays 71, 75 are attached and detached in accordance with a content of the maintenance operation.

The tray 71 is open at a side face thereof opposite to the ink-jet heads 2, and when the trays 71, 75 are disengaged in the wiping operation, for example, only the tray 71 is movable with the tray 75 remaining at its original position. Further, regardless of an engagement state of the engaging means, when the maintenance unit 70 is horizontally moved in a manner described below, the frame 4 is moved upward to the head maintenance position located higher than the print position (i.e., in a direction indicated by arrow C in FIG. 3), so that a space for the maintenance unit 70 is assured between the four ink-ejection surfaces 3*a* and the outer peripheral surface 8*a*. Then, the maintenance unit 70 is horizontally moved in a direction indicated by arrow D in FIG. 3.

A waste-ink receiving tray 77 is disposed just below the maintenance unit 70. This waste-ink receiving tray 77 has a size enclosing the tray 71 in plan view. Even when the tray 71 is moved to an right end of the ink-jet printer 1 in FIG. 2, the waste-ink receiving tray 77 overlaps with one of opposite end portions of the tray 71, which one is located on a side opposite to the ink-jet heads 2. An ink-discharge hole 77*a* is vertically formed through one of opposite end portions of the waste-ink receiving tray 77 which one is nearer to the ink-jet heads 2. The ink-discharge hole 77*a* guides or discharges, to a waste-ink accumulating portion (not shown), the inks flown onto the waste-ink receiving tray 77.

A wiper 72 and the tray 75 are disposed in the tray 71 with the wiper 72 located nearer to the ink-jet heads 2 than the tray 75. The wiper 72 is a plate-like member formed of an elastic material and is for wiping the ink-ejection surfaces 3*a* in the wiping operation described below. The wiper is disposed so as to extend in a direction parallel to the sheet feeding direction B. As shown in FIG. 2, in the tray 75, the four caps 76 each having a rectangular shape in plan view are arranged side by side in correspondence with the respective ink-ejection surfaces 3*a* of the ink-jet heads 2. The longitudinal direction of the caps 76 is made parallel to a longitudinal direction of the ink-jet heads 2. The caps 76 are disposed in the sheet feeding direction B with pitches which are the same as pitches with which the ink-jet heads 2 are disposed in the sheet feeding direction B. Further, the caps 76 are movably supported by respective cap mechanisms 90 by being subjected to a specific pressing force in the vertical direction. The tray 75, the four caps 76, and the cap mechanisms 90 respectively corresponding to the caps 76 constitute a head cap unit.

Figure 5A:
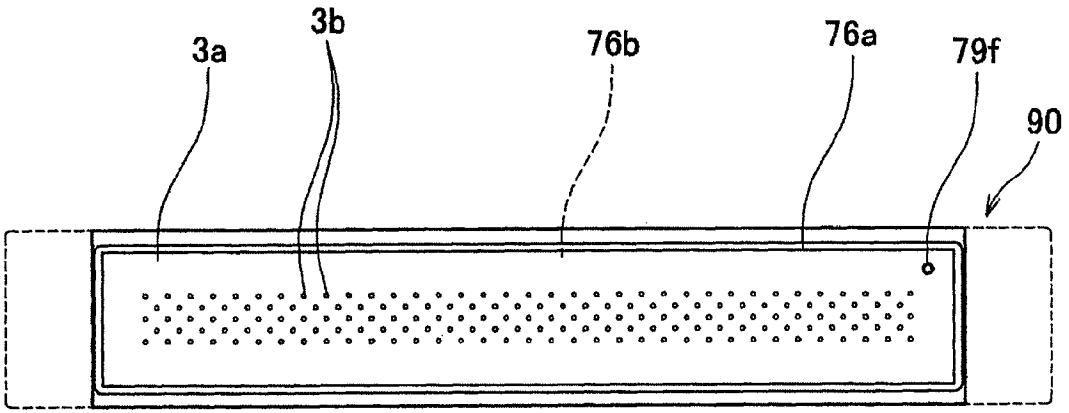
FIG. 5A is a plan view of one of cap mechanisms.
Figure 5B:
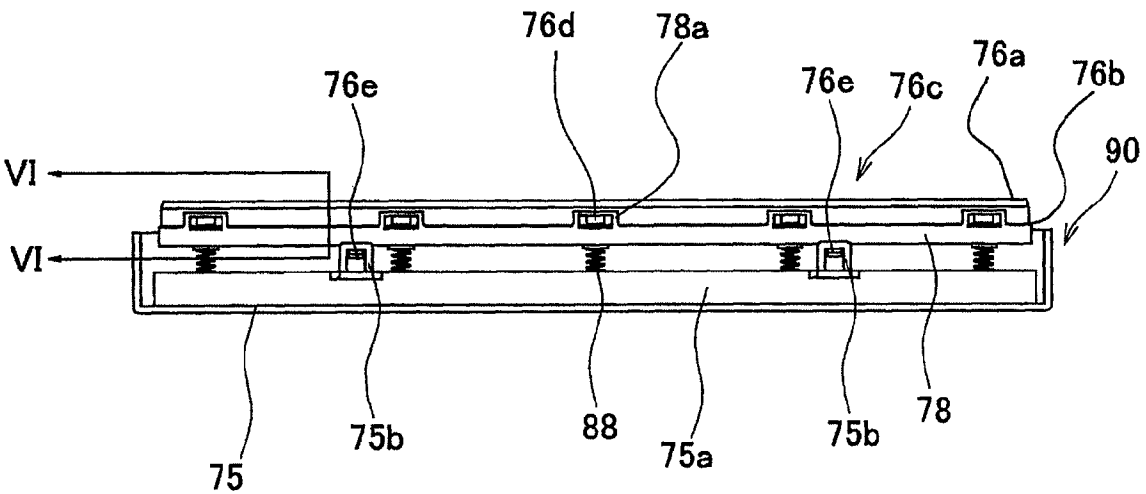
FIG. 5B is a side view of the cap mechanism.

There will be explained the cap mechanisms 90 in detail with further reference to FIGS. 5A, 5B, 6A, 6B, and 6C. It is noted that, in FIG. 5A, the ink-ejection surface 3*a* is shown in solid lines. Each of the cap mechanisms 90 is a unit in which the cap 76, a holder 78, springs 88, and the tray 75 are disposed in order from above. As shown in FIG. 5A, each cap mechanism 90 has a generally rectangular outer shape in plan view. The cap 76 is held by the holder 78. As shown in FIG. 5B, on each of opposite side faces of the cap 76 (i.e., a bottom plate portion 76*b*), there are formed five engaging projections 76*d* spaced at regular intervals. Each of the engaging projections 76*d* projects outward in a widthwise direction of the cap 76. In correspondence with this, on each of opposite side faces of the holder 78 which extend in a longitudinal direction thereof, five engaging portions 78*a* are formed. Each of the engaging portions 78*a* has a hole engageable with a corresponding one of the engaging projections 76*d* and is engaged therewith. This engagement causes a bottom surface (a first surface) of the cap 76 to be pressed to an upper or front surface (a second surface) of the holder 78 by a predetermined pressing force.

The holder 78 is supported by the tray 75 via the five springs 88. The springs 88 bias the holder 78 in a direction (i.e., an upward direction) in which the holder 78 moves away from the tray 75. As shown in FIG. 5B, the tray 75 is a box opening upward and includes therein a supporting stage 75*a* and engaging portions 75*b*. The supporting stage 75*a* is fixed to the bottom surface of the tray 75 and supports basal end portions of the respective springs 88 arranged and spaced at the regular intervals. On each of opposite side end portions in a widthwise direction of the supporting stage 75*a*, the two engaging portions 75*b* are provided upright. On each of the opposite side faces of the holder 78 in the longitudinal direction thereof, two engaging projections 76*e* are formed. Each of the engaging projections 76*e* projects outward in a widthwise direction of the holder 78 and is engaged with a corresponding one of holes of the respective engaging portions 75*b*. Each of the holes of the respective engaging portions 75*b* has such a shape that the engaging projections 76*e* are displaceable upward and downward by a predetermined distance.

As a result, when each cap 76 is brought into contact with the corresponding ink-ejection surface 3*a*, the springs 88 reduce an impact force generated by the contact and press the cap 76 to the ink-ejection surface 3*a* by a predetermined pressing force. In this time, a closed space is formed or defined by the cap 76 and the ink-ejection surface 3*a*. Further, even where a degree of parallelization of the cap 76 to the ink-ejection surface 3*a* has an error to a certain extent, it becomes possible that the cap 76 can smoothly follow the ink-ejection surface 3*a*.

As shown in FIGS. 5A, 5B, 6A, 6B, and 6C, each of the caps 76 includes (a) a circular projection 76*a* as a lip portion projecting upward and having a generally rectangular and circular shape as seen from an upper surface of the holder 78 and (b) the bottom plate portion 76*b* having an outer peripheral end portion to which a basal end portion of the circular projection 76*a* is connected and having a generally rectangular shape extending in one direction. The circular projection 76*a* and the bottom plate portion 76*b* are each formed of an elastic material such as a rubber and a resin, and integrally define a recessed portion 76*c* opening upward. When the circular projection 76*a* and a corresponding one of the ink-ejection surfaces 3*a* contact with each other by the capping operation which will be described below, the cap 76 seals the nozzles 3*b*.

Figure 6A:
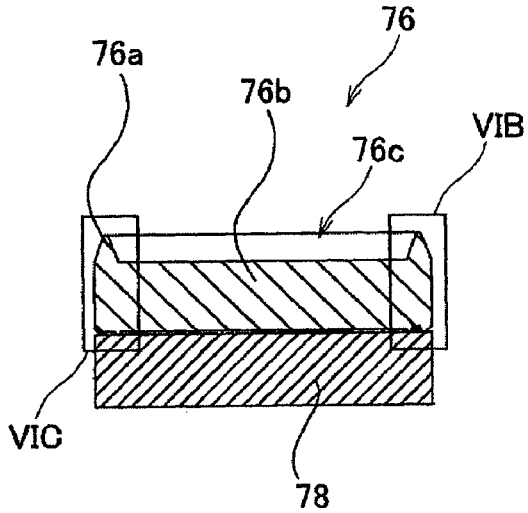
FIG. 6A is a cross-sectional view taken along line VI-VI of FIG. 5.
Figure 6B:
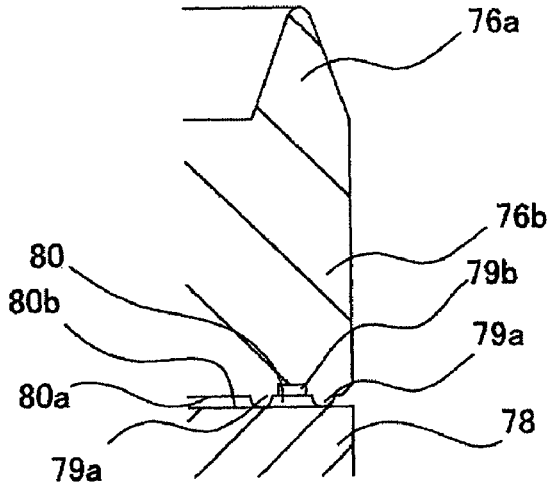
FIG. 6B is an enlarged view of a rectangular area VIB shown in FIG. 6A.
Figure 6C:
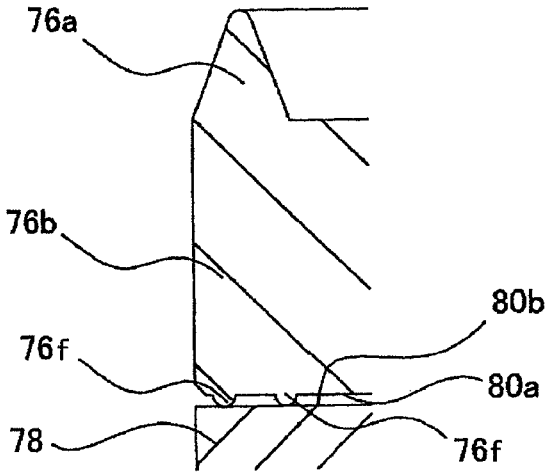
FIG. 6C is an enlarged view of a rectangular area VIC shown in FIG. 6A.

On and in the back surface (the first surface) 80*a* of the bottom plate portion 76*b*, there are respectively formed a pair of wall bodies 79*a*, a groove 79*b* shown in FIG. 6B, and a pair of dummy wall bodies 76*f* shown in FIG. 6C. This ink-jet printer 1 features that the wall bodies 79*a*, 76*f* of two types are superposed on the circular projection 76*a* in plan view. It is noted that the disposing of the pair of wall bodies 79*a* such that the pair of wall bodies 79*a* are superposed on the circular projection 76*a* in plan view refers to that a line extending through a top of the circular projection 76*a* as seen in a direction perpendicular to the back surface 80*a* or the upper surface of the holder 78 exists between respective two wall bodies of the pair of the wall bodies 79*a*. Likewise, the disposing of the pair of dummy wall bodies 76*f* such that the pair of dummy wall bodies 76*f* are superposed on the circular projection 76*a* in plan view refers to that the line extending through the top of the circular projection 76*a* as seen in the direction perpendicular to the back surface 80*a* or the upper surface of the holder 78 exists between respective two wall bodies of the pair of dummy wall bodies 76*f*.

Figure 7:
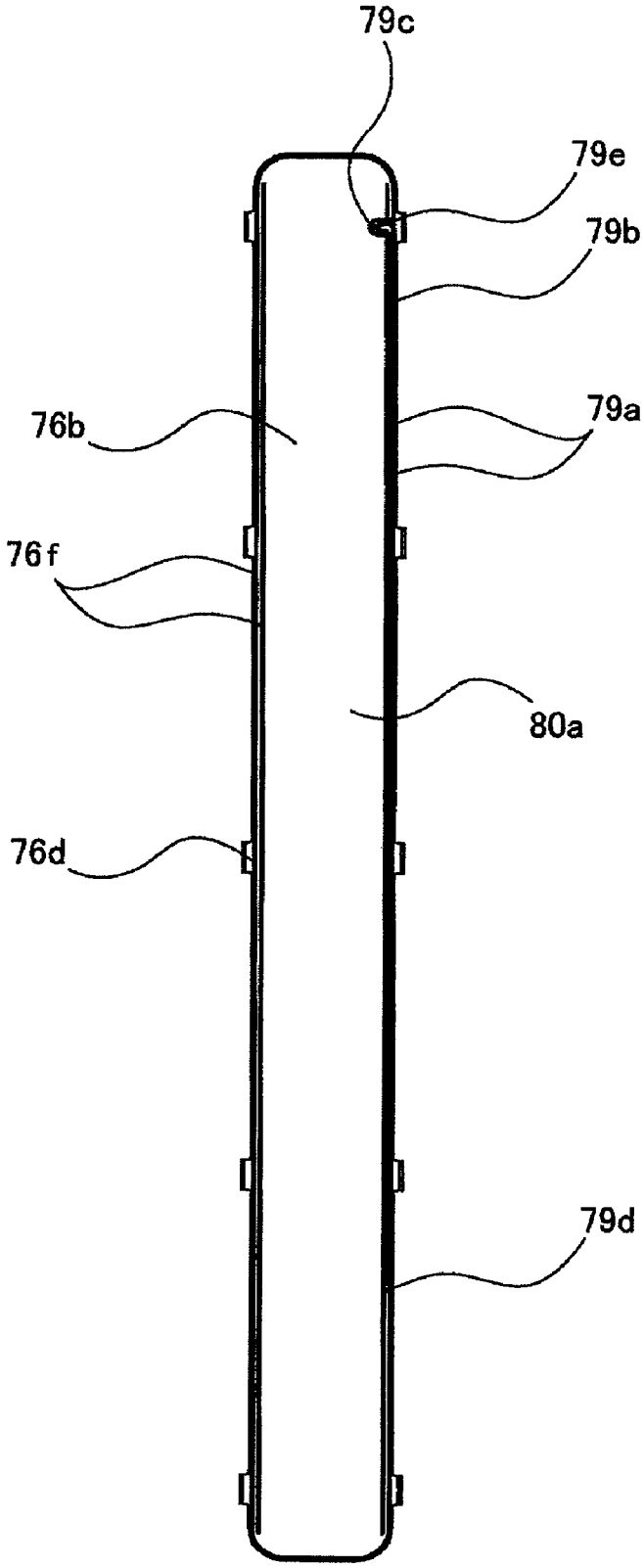
FIG. 7 is a bottom view of the bottom plate portion shown in FIG. 5.

Each of the wall bodies 79*a*, 76*f* projects from the back surface 80*a* so as to have an arch shape in cross section. The pair of wall bodies 79*a* and the groove 79*b* define, with the front surface (the second surface) 80*b*, a channel having a predetermined channel resistance to a flow of air in a state in which the cap 76 is engaged with the holder 78, thereby communicating the closed space defined by the cap 76 and the ink-ejection surface 3*a* with an outside. On the other hand, the pair of dummy wall bodies 76*f* function to uniformly add an engagement force of the cap 76 and the holder 78 to the pair of wall bodies 79*a*. Thus, as shown in FIG. 7, the pair of wall bodies 79*a* and the pair of dummy wall bodies 76*f* are disposed so as to be symmetrical with each other about a center line extending in a longitudinal direction of the bottom plate portion 76*b*. Further, as shown in FIG. 6B, the pair of wall bodies 79*a* are respectively disposed at positions symmetrical with each other with respect to the perpendicular line extending through the top of the circular projection 76*a*. Likewise, as shown in FIG. 6C, the pair of dummy wall bodies 76*f* are respectively disposed at positions symmetrical with each other with respect to the perpendicular line extending through the top of the circular projection 76*a*. In other words, the line extending through the top (i.e., a distal end) of the circular projection 76*a* (i.e., the line perpendicular to the back surface 80*a*) extends so as to be interposed between the respective two bodies of the pair of wall bodies 79*a*. Likewise, the perpendicular line extending through the top of the circular projection 76*a* extends so as to be interposed between respective two bodies of the pair of dummy wall bodies 76*f*. Further, a point at which the perpendicular line extending through the top of the circular projection 76*a* and the back surface 80*a* intersect each other is located equidistant from the respective two bodies of the pair of wall bodies 79*a*. Likewise, the point is located equidistant from the respective two bodies of the pair of dummy wall bodies 76*f*. Further, the groove 79*b* is located just under the top of the circular projection 76*a*, and the perpendicular line extends through a center of the groove 79*b* in a widthwise direction thereof.

Figure 8:
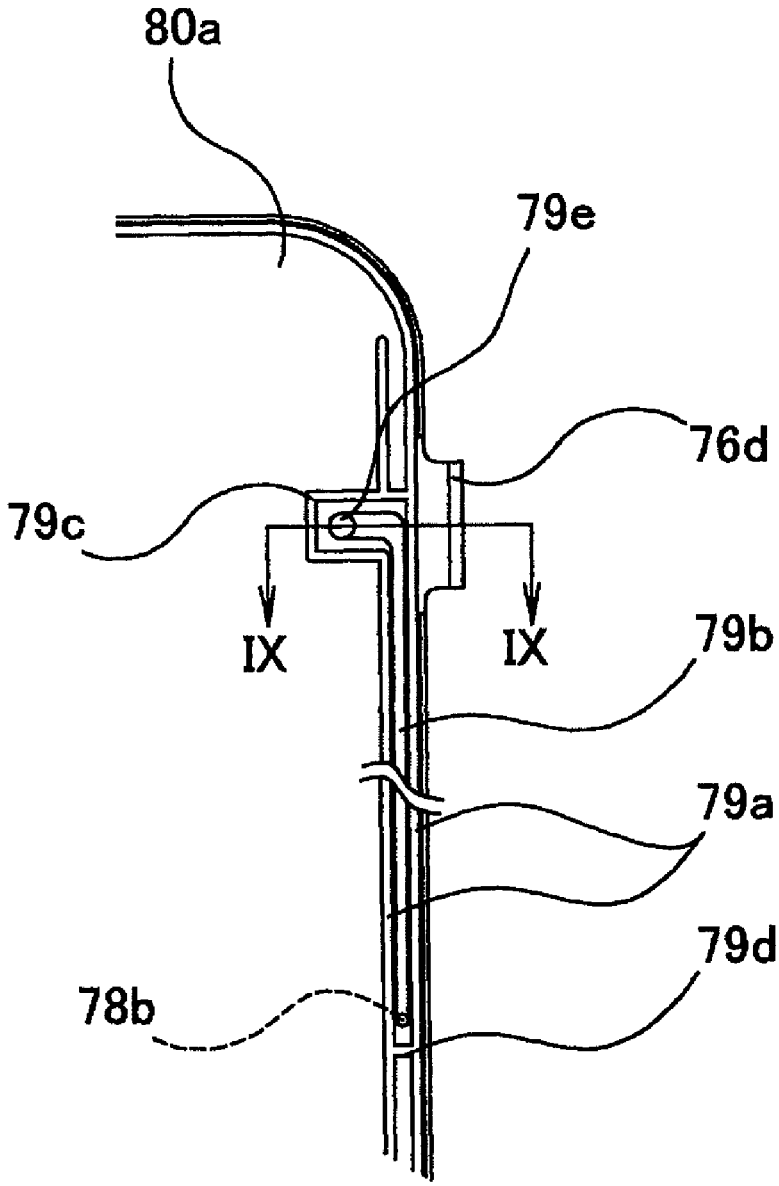
FIG. 8 is a partially enlarged view of the bottom plate portion shown in FIG. 7.
Figure 9:
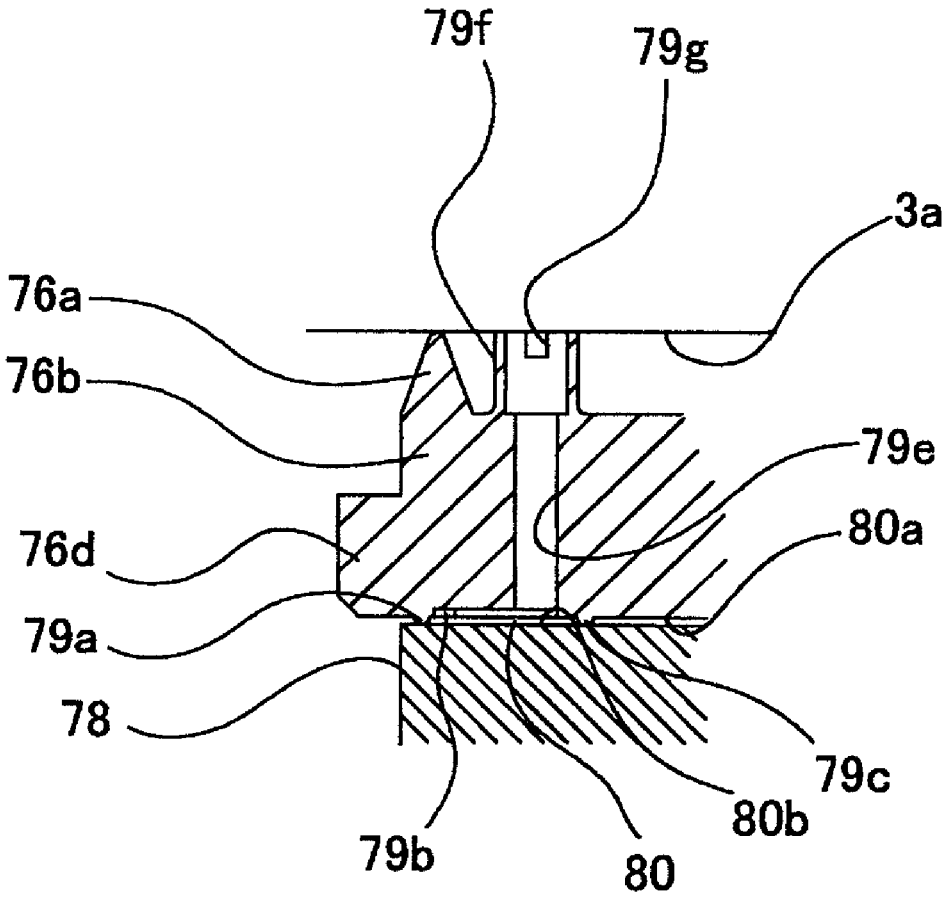
FIG. 9 is a cross-sectional view taken along line IX-IX of FIG. 8.

There will be explained the bottom plate portion 76*b* with further reference to FIGS. 7-9. It is noted that FIG. 9 shows the ink-ejection surface 3*a*, cap 76, and the holder 78 in a state in which the distal end of the circular projection 76*a* is held in contact with the ink-ejection surface 3*a*. As shown in FIGS. 7-9, in addition to the pair of wall bodies 79*a*, the groove 79*b*, and the dummy wall bodies 76*f*, connecting portions 79*c*, 79*d* are formed on the back surface (the first surface) 80*a* of the bottom plate portion 76*b* which contacts with the holder 78.

Further, a contact body 79*f* is provided upright or erectly on a bottom surface of the recessed portion 76*c* of the bottom plate portion 76*b*. The pair of wall bodies 79*a*, the groove 79*b*, the connecting portions 79*c*, 79*d*, the dummy wall bodies 76*f*, and the contact body 79*f* are formed integrally with the bottom plate portion 76*b*.

The pair of wall bodies 79*a* extend along one side face of the bottom plate portion 76*b* in a longitudinal direction thereof near one side end portion (i.e., a right side end portion in FIG. 7) in a widthwise direction of the bottom plate portion 76*b*. The groove 79*b* extends along the pair of wall bodies 79*a* while being interposed or nipped therebetween as seen in the direction perpendicular to the back surface 80*a*. Further, at a portion of the back surface 80*a* near an upper end portion thereof in FIG. 7, the groove 79*b* bends inward from an area opposed to the circular projection 76*a* and then extends to an area opposed to the bottom surface of the recessed portion 76*c*. That is, the pair of wall bodies 79*a* extend to a position at which the perpendicular line extending through the distal end of the circular projection 76*a* is not interposed between the pair of wall bodies 79*a*. A distal end of the groove 79*b* is connected to a through hole 79*e* formed through the bottom plate portion 76*b* from the bottom surface of the recessed portion 76*c*. That is, the recessed portion 76*c* and the groove 79*b* are communicated with each other via the through hole 79*e*. The other end of the groove 79*b* faces to (i.e., is communicated with) an opening of a through hole 78*b* formed through the holder 78. It is noted that the area opposed to the circular projection 76*a* refers to a portion of the back surface 80*a* which corresponds, in the direction perpendicular to the back surface 80*a*, to a portion of the cap 76 in which the circular projection 76*a* is formed (which portion includes a portion of the cap 76 that is other than the bottom surface of the recessed portion 76*c* and that also includes a portion of the cap 76 other than the top of the circular projection 76*a*). That is, in FIG. 6B, where lines perpendicular to the back surface 80*a* are drawn respectively from right and left end parts of the portion of the back surface 80*a* in which the circular projection 76*a* is formed, a portion of the back surface 80*a* interposed between the lines is the area opposed to the circular projection 76*a*.

The connecting portions 79*c*, 79*d* are for connecting or coupling the pair of wall bodies 79*a* and project in the direction perpendicular to the back surface 80*a* so as to have the same height as the wall bodies 79*a*. The connecting portion 79*c* extends along an edge portion of the through hole 79*e* (i.e., one end of the groove 79*b*) and is connected at opposite ends thereof respectively to end portions of the respective wall bodies 79*a*. In this time, as seen in the direction perpendicular to the back surface 80*a*, the connecting portion 79*c* partly surrounds the through hole 79*e*, in other words, surrounds the through hole 79*e* in a three-sided rectangular shape. Further, at an area opposed to the circular projection 76*a*, opposed ends of the connecting portion 79*d* are respectively connected to the pair of wall bodies 79*a* at a position near the other end of the groove 79*b*. The connecting portions 79*c*, 79*d* constitute a circular channel wall enclosing the groove 79*b* together with the pair of wall bodies 79*a* as seen in the direction perpendicular to the back surface 80*a*. A distal end of this channel wall has a curved surface having a convex or gibbous shape. In other words, a surface of the distal end is provided by the curved surface having the convex shape. The distal end of the channel wall contacts with the front surface 80*b* of the holder 78, whereby the channel wall is nipped by the back surface 80*a* of the bottom plate portion 76*b* and the front surface 80*b* of the holder 78. In this time, as shown in FIG. 9, the front surface 80*b* and the back surface 80*a* including the pair of wall bodies 79*a*, the connecting portions 79*c*, 79*d*, and the groove 79*b* define an air communicating channel 80.

As shown in FIG. 9, the contact body 79*f* is formed by a hollow circular cylinder. Further, as seen in the direction perpendicular to the back surface 80*a*, the contact body 79*f* is disposed such that an inner wall surface of the contact body 79*f* encloses an opening of the through hole 79*e* and such that a basal end portion of the contact body 79*f* overlaps or is superposed on a part of the connecting portion 79*c* and the pair of wall bodies 79*a*. The contact body 79*f* is made such that a height from the bottom surface of the recessed portion 76*c* to a distal end of the contact body 79*f* is the same as that from the bottom surface to the distal end of the circular projection 76*a*. A slit 79*g* is formed in a side face of the contact body 79*f* which is nearer to the distal end thereof. Thus, the air communicating channel 80 is communicated at one end thereof with the recessed portion 76*c* (the closed space) via the through hole 79*e* of the bottom plate portion 76*b* and the slit 79*g* of the contact body 79*f*, and communicated at the other end thereof with the air via the through hole 78*b* of the holder 78. It is noted that the contact body 79*f* is brought into contact with an area (with reference to FIG. 5A) of the ink-ejection surface 3*a* in which the nozzles 3*b* are not formed, in the capping operation which will be described below.

The dummy wall bodies 76*f* extend along another side face of the bottom plate portion 76*b* in the longitudinal direction thereof near the other side end portion in the widthwise direction of the bottom plate portion 76*b*. The dummy wall bodies 76*f* have the same height and cross-sectional shape as the pair of wall bodies 79*a* and project in the direction perpendicular to the back surface 80*a*. In this ink-jet printer 1, the dummy wall bodies 76*f* are formed so as to extend over a substantially entire length of the bottom plate portion 76*b* like the pair of wall bodies 79*a*. It is noted that the dummy wall bodies 76*f* may extend over an entire area in which the pair of wall bodies 79*a* are not formed, in a state in which the dummy wall bodies 76*f* are opposed to the circular projection 76*a*.

In performing the capping operation which will be described below, since the circular projection 76*a* is pressed to the ink-ejection surface 3*a*, the pair of wall bodies 79*a* and the connecting portion 79*d* are directly subjected to the pressing force and thus are pressed to the front surface 80*b* of the holder 78 at a relatively high pressure. In this time, the contact body 79*f* is pressed to the area (with reference to FIG. 5A) of the ink-ejection surface 3*a* in which the nozzles 3*b* are not formed, in other words, the contact body 79*f* is brought into contact with the area of the ink-ejection surface 3*a* other than the ink-ejection area. The connecting portion 79*c* opposed to the contact body 79*f* is also pressed to the front surface 80*b* of the holder 78 at the relatively high pressure. As a result, respective distal ends of the pair of wall bodies 79*a* and the connecting portions 79*c*, 79*d* reliably contact with the front surface 80*b* of the holder 78, and thus the air communicating channel 80 is formed, so as to have the predetermined channel resistance, by the circular channel wall including the pair of wall bodies 79*a* and the connecting portions 79*c*, 79*d*, the back surface 80*a* of the bottom plate portion 76*b* including the groove 79*b*, and the front surface 80*b* of the holder 78.

As shown in FIGS. 2 and 3 again, a holding member 74 holding the wiper 72 is fixed to a portion of the tray 71 which is nearer to the inkjet heads 2. The holding member 74 has a U-shape in its plan view, and the wiper 72 is held at a portion of the holding member 74 along the sheet feeding direction B. On the other hand, recessed portions 74*a* partly constituting the engaging means are respectively formed on end parts of respective portions of the holding member 74 which portions extend in the direction perpendicular to the sheet feeding direction B.

The tray 71 and the tray 75 are engaged with each other by the above-described engaging means so as to be attachable and detachable. The engaging means are respectively disposed near upper and lower ends of the trays 71, 75 in FIG. 2 and each mainly constituted by a corresponding one of the recessed portions 74*a* formed in the holding member 74 of the tray 71 and a hook member 83 pivotably supported by the tray 75. The hook member 83 extends in the direction perpendicular to the sheet feeding direction B, and is pivotably supported at a central portion thereof. A hook portion 83*a* which engages the recessed portion 74*a* is formed on one of opposite end portions of the hook member 83 nearer to the ink-jet heads 2. Above the maintenance unit 70, there is pivotably supported a contact member 84 that can contact with an end portion 83*b* of each hook member 83 which is located furthest from the ink-jet heads 2. When each contact member 84 is pivoted to contact with the end portion 83*b*, the hook portion 83*a* and the recessed portion 74*a* are disengaged from each other. On the other hand, when the contact member 84 is moved away from the end portion 83*b*, the hook portion 83*a* is engaged with the recessed portion 74*a* and returns to a state shown in FIG. 3.

When the maintenance operation of the inkjet heads 2 which will be described below is not performed, the maintenance unit 70 is, as shown in FIG. 3, at rest at a "retracted position" distant from the ink-jet heads 2 (i.e., a left position in FIG. 2 at which the maintenance unit 70 does not face the ink-jet heads 2). When the maintenance operation is performed, the maintenance unit 70 is horizontally moved from the retracted position to a "maintenance position" or an "opposed position" at which the maintenance unit 70 faces or is opposed to the ejection surfaces 3*a* of the respective ink-jet heads 2. In this movement, distal ends of the wiper 72 and the circular projection 76*a* are not brought into contact with the ejection surfaces 3*a* because the ink-jet heads 2 are disposed at the head maintenance position located above the maintenance position.

It is noted that even when the maintenance operation is performed, only the tray 71 is moved, in the wiping operation, from the retracted position to a position under the ink-jet heads 2 to receive the inks wiped by the wiper 72, with the tray 75 remaining at its original position. When the ejection surfaces 3*a* are covered by the respective caps 76 in a stand-by state of the ink-jet printer 1 and in the purging operation, the tray 71 and the tray 75 are connected to each other and moved to the maintenance position.

As shown in FIG. 2, the trays 71, 75 are movably supported by a pair of guide shafts 96*a*, 96*b* extending in the direction perpendicular to the sheet feeding direction B. Two bearing members 97*a*, 97*b* are provided on the tray 71. The bearing members 97*a*, 97*b* are projected from respective upper and lower side faces of the holding member 74. Two bearing members 98*a*, 98*b* are provided on the tray 75. The bearing members 98*a*, 98*b* are projected from the respective upper and lower side faces of the tray 75. The pair of guide shafts 96*a*, 96*b* are respectively fixed, at opposite ends thereof, to a main body frame 1*e* and a main body frame 1*g*, and disposed so as to be parallel to each other between the main body frames 1*e*, 1*g*. Here, the pair of guide shafts 96*a*, 96*b* are fixed by screws. In this configuration, each of the trays 71, 75 is moved along the guide shafts 96*a*, 96*b* in a right and left direction in FIG. 2 (indicated by arrow D).

Here, there will be explained a horizontally moving mechanism 91 for horizontally moving the trays 71, 75. As shown in FIG. 2, the horizontally moving mechanism 91 includes a motor 92, a motor pulley 93, an idle pulley 94, a timing belt 95, the guide shafts 96*a*, 96*b*, and so on. The motor 92 is fixed by, e.g., screws to a mount portion 1*f* formed at one of end portions of the main body frame 1*e* extending in the direction parallel to the sheet feeding direction B. The motor pulley 93 is connected to the motor 92, and rotated in accordance with driving of the motor 92. The idle pulley 94 is rotatably supported by the main body frame 1*g* located at the most left side of the ink-jet printer 1 in FIG. 2. The timing belt 95 is disposed so as to be parallel to the guide shaft 96*a* and wound around the motor pulley 93 and the idle pulley 94 to bridge the motor pulley 93 and the idle pulley 94. The timing belt 95 is connected to the bearing member 97*a* provided on the holding member 74.

In this construction, when the motor 92 is driven, the timing belt 95 is rotated in accordance with a forward or a reverse rotation of the motor pulley 93. By the rotation of the timing belt 95, the tray 71 connected to the timing belt 95 via the bearing member 97*a* is moved leftward or rightward in FIG. 2, that is, in a direction toward the retracted position or the maintenance position. It is noted that in a state in which the recessed portion 74*a* of the holding member 74 and the hook portion 83*a* are engaged with each other, the wiper 72 in the tray 71 and the caps 76 in the tray 75 are moved together with each other. On the other hand, in a state in which the hook portion 83*a* and the recessed portions 74*b* are not engaged with each other, only the wiper 72 in the tray 71 is moved.

Figure 10A:
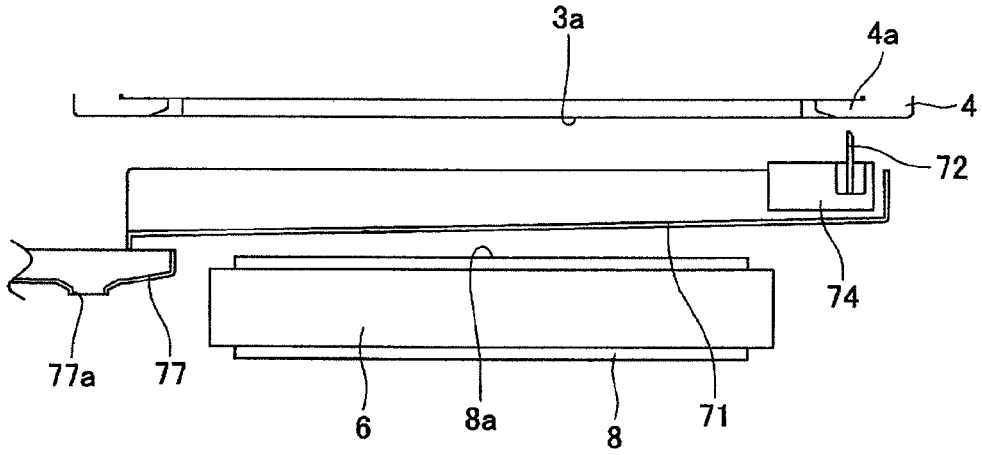
FIG. 10A is a view showing a case in which one of the ink-jet heads shown in FIG. 2 is moved from a "print position" to a "head maintenance position" while a tray of a maintenance unit is moved to a "maintenance position"
Figure 10B:
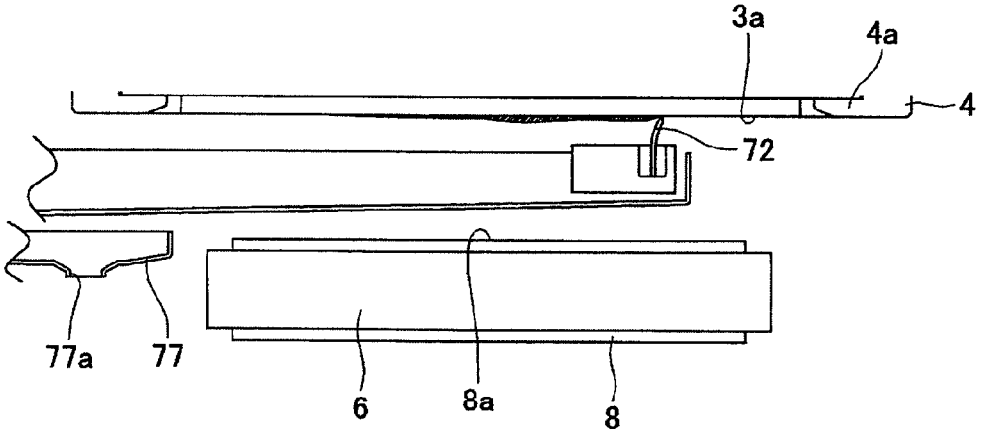
FIG. 10B is a view showing a case in which an ink adhering to the ink-ejection surface is being wiped by a wiper shown in FIG. 2.
Figure 11:
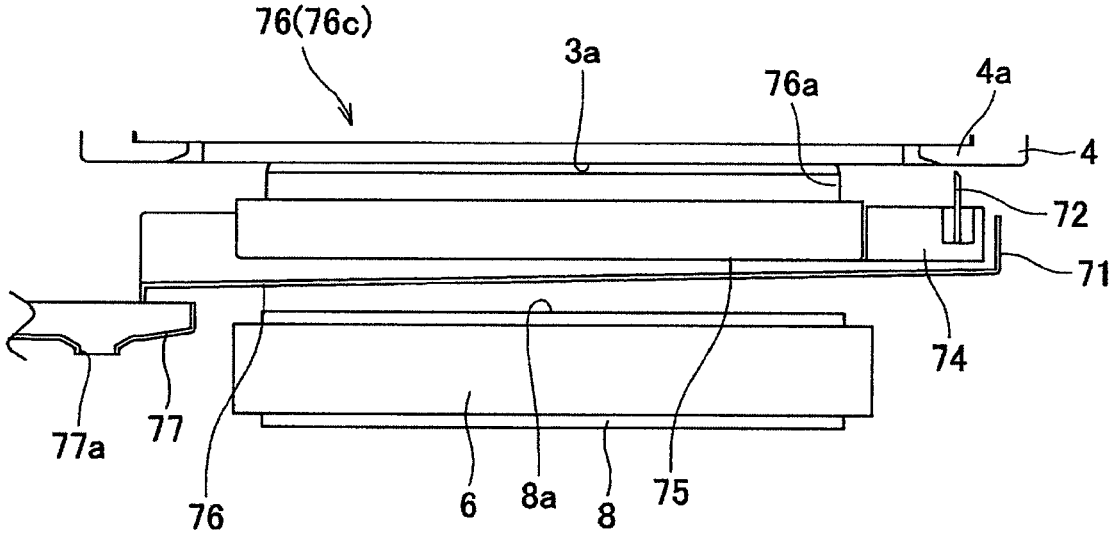
FIG. 11 is a view showing a case in which a circular projection of a cap shown in FIG. 5 and an ink-ejection surface of the ink-jet head contact with each other.

There will be next explained an operation of the maintenance unit 70 with reference to FIGS. 10A, 10B, and 11.

In the maintenance operation, in order to perform the purging operation for recovering the ink-jet heads 2 in which, e.g., ink ejection failure occurs, the frame 4 is initially moved upward by the frame moving mechanisms 51, whereby the ink-jet heads 2 are disposed at the head maintenance position. As a result, the space in which the maintenance unit 70 can be disposed is formed between the ink-ejection surfaces 3*a* and the sheet-feed belt 8. The ink-ejection surfaces 3*a* of the respective ink-jet heads 2 located at the head maintenance position are located at a position at which the ink-ejection surfaces 3*a* are not brought into contact with the respective distal ends of the wiper 72 and the circular projection 76*a* when the maintenance unit 70 is moved to the maintenance position.

Then, by the horizontally moving mechanism 91, the contact member 84 is brought into contact with the end portion 83*b* of the hook member 83, whereby the hook portion 83*a* is moved away from the recessed portion 74*a*, and thus the hook portion 83*a* and the recessed portion 74*a* are disengaged from each other. That is, a state in which the tray 71 and the tray 75 are disengaged from each other is established. In this state, as shown in FIG. 10A, the tray 71 is moved from the retracted position to the maintenance position by the horizontally moving mechanism 91.

Next, in this state, the pump, not shown, forcing the ink in each ink tank 49 to feed to the corresponding ink-jet head 2 is driven, and the purging operation is performed in which the ink is ejected from the nozzles 3*b* of the ink-jet head 2 into the tray 71. This purging operation resolves clogging of the nozzles 3*b* of the ink-jet head 2 in which the ink ejection failure occurs, and thickening of the ink in the nozzles 3*b*. The ink ejected into the tray 71 is transferred on the tray 71 and then flowed into the waste-ink receiving tray 77. Then, the ink is discharged from the ink-discharge hole 77*a* of the waste-ink receiving tray 77.

Next, the ink-jet heads 2 are moved downward by the frame moving mechanisms 51 in order to perform the wiping operation. In this time, when the tray 71 is moved leftward in FIGS. 10A and 10B (that is, in a direction from the maintenance position toward the retracted position), the ink-jet heads 2 are disposed at a position (i.e., a "wiping position") at which the distal end of the wiper 72 can contact with the ink-ejection surfaces 3*a*. Then, as shown in FIG. 10B, the tray 71 is moved from the maintenance position to the retracted position by the horizontally moving mechanism 91.

In this wiping operation, since an upper end of the wiper 72 is located above the ink-ejection surfaces 3*a*, the wiper 72 contacts with the ink-ejection surfaces 3*a* while bending, thereby wiping the inks adhering to the ink-ejection surfaces 3*a* by the purging operation. The inks wiped by the wiper 72 are transferred on a surface of the wiper 72 and then flowed into the waste-ink receiving tray 77. Then, the inks are discharged from the ink-discharge hole 77*a* of the waste-ink receiving tray 77.

As thus described, the maintenance operation is completed in which the ink-jet heads 2 being subjected to the ink ejection failure and the like are recovered by the purging operation, and the inks adhering to the respective ink-ejection surfaces 3*a* in the purging operation are wiped by the wiping operation.

There will be next explained the capping operation in which each ink-ejection surface 3*a* is covered with the corresponding cap 76 in a resting mode of the ink-jet printer 1 in which, e.g., recording with respect to the sheets by the ink-jet printer 1 is not performed for a relatively long time. Also in this case, like the above-described case, the frame 4 is moved upward by the frame moving mechanisms 51, whereby the ink-jet heads 2 are disposed at the head maintenance position.

Then, as shown in FIG. 11, the tray 71 and the tray 75 are moved from the retracted position to the maintenance position by the horizontally moving mechanism 91 in a state in which the tray 71 and the tray 75 are connected to each other by the hook member 83. In this time, the recessed portion 76*c* of each cap 76 is disposed at a position facing a surrounding of an area in which the corresponding nozzles 3*b* are formed. Further, each ink-jet head 2 is moved downward by the frame moving mechanisms 51 toward a position (i.e., a capping position) at which each circular projection 76*a* is brought into contact with the corresponding ink-ejection surface 3*a*. As thus described, the ink-ejection surface 3*a* is covered with the recessed portion 76*c* of the cap 76 to be sealed.

In this time, as described above, the circular projection 76*a* is pressed to the ink-ejection surface 3*a*, and the pair of wall bodies 79*a* and the connecting portion 79*d* are pressed to the front surface 80*b* of the holder 78 at the relatively high pressure. Further, the contact body 79*f* is pressed to the ink-ejection surface 3*a*, and the connecting portion 79*c* is also pressed to the front surface 80*b* of the holder 78 at the relatively high pressure. As a result, the respective distal ends of the pair of wall bodies 79*a* and the connecting portions 79*c*, 79*d* reliably contact with the front surface 80*b* of the holder 78, and thus the air communicating channel 80 is reliably formed by the circular channel wall including the pair of wall bodies 79*a* and the connecting portions 79*c*, 79*d*, the back surface 80*a* of the bottom plate portion 76*b* including the groove 79*b*, and the front surface 80*b* of the holder 78. In this time, a distal end of the circular channel wall is deformed, whereby the air communicating channel 80 by the groove 79*b* can be certainly formed. By the operation as described above, the capping operation is completed. As a result, drying of the nozzles 3*b* can be prevented in the stand-by state of the ink-jet printer, and a pressure difference between an inside of the cap 76 and an outside can be resolved.

According to the inkjet printer 1 as the above-described present embodiment, when the capping operation is performed, the pair of wall bodies 79*a* and the connecting portion 79*d* are pressed to the front surface 80*b* of the holder 78 at the relatively high pressure, whereby the air communicating channel 80 is reliably formed. Thus, the recessed portion 76*c* and the air can be reliably communicated with each other at the predetermined channel resistance.

Further, since the pair of wall bodies 79*a* are formed on the back surface 80*a* of the bottom plate portion 76*b*, positioning of the wall bodies 79*a* becomes easy, whereby the air communicating channel 80 can be formed more reliably.

Further, the pair of wall bodies 79*a* and the contact body 79*f* are formed integrally with the bottom plate portion 76*b*, thereby leading to a lower cost of the cap 76.

In addition, since the pair of wall bodies 79*a* and the groove 79*b* are formed on and in the back surface 80*a* of the bottom plate portion 76*b*, a deviation between the pair of wall bodies 79*a* and the groove 79*b* does not occur, whereby the air communicating channel 80 can be formed more reliably.

Further, since each of the respective end surfaces of the wall bodies 79*a* and the connecting portion 79*c* is formed by the convex curved surface, the respective end surfaces of the wall bodies 79*a* are pressed to the front surface 80*b* of the holder 78 at a higher pressure. Thus, the air communicating channel 80 can be formed much more reliably.

Further, since the dummy wall bodies 76*f* are formed on the area of the back surface 80*a* of the bottom plate portion 76*b* in which the pair of wall bodies 79*a* are not formed and which is included in the area of the back surface 80*a* opposed to the portion of the circular projection 76*a* that extends in the longitudinal direction thereof, inclination of the bottom plate portion 76*b* relative to the holder 78 can be restrained.

In addition, the contact body 79*f* is provided upright on the bottom surface of the recessed portion 76*c*, and the contact body 79*f* is opposed to a part of the connecting portion 79*c*. Further, the height of the distal end of the contact body 79*f* from the bottom surface of the recessed portion 76*c* is made the same as the height of the distal end of the circular projection 76*a* from the bottom surface. Thus, when the capping operation is performed, the contact body 79*f* is reliably pressed to the ink-ejection surface 3*a*, and the connection portion 79*c* opposed to the contact body 79*f* can be also pressed to the front surface 80*b* of the holder 78 at the relatively high pressure. As a result, the through hole 79*e* can be formed at a position distant from the circular projection 76*a*, whereby a uniform deformation of the circular projection 76*a* in the capping operation is not inhibited.

Further, since the contact body 79*f* is, as seen in the direction perpendicular to the back surface 80*a*, disposed such that the wall surface of the contact body 79*f* encloses the opening of the through hole 79*e* and such that the contact body 79*f* overlaps or is superposed on the part of the connecting portion 79*c*, a pressure generated when the contact body 79*f* is brought into contact with the ink-ejection surface 3*a* is directly applied to the connecting portion 79*c*. Thus, the air communicating channel 80 can be formed more reliably.

Further, in the above-described embodiment, when the ink-ejection surface 3*a* and the contact body 79*f* provided upright so as to communicate with the opening of the through hole 79*e* contact with each other, the distal end of the contact body 79*f* contacts with the area of the ink-ejection surface 3*a* in which the nozzles 3*b* are not formed. Thus, since the pair of wall bodies 73*a* formed opposed to the contact body 79*f* are strongly pressed to the bottom plate portion 76*b* and the holder 78 when the contact body 79*f* is pressed to the ink-ejection surface 3*a*, the pair of wall bodies 73*a* formed on a periphery of the opening of the through hole 79*e* can closely contact with the bottom plate portion 76*b* and the holder 78. Thus, the opening of the through hole 79*e* can be formed at a position distant from the circular projection 76*a*, thereby assuring a uniform close contact of the circular projection 76*a* and the ink-ejection surface 3*a*.

Figure 12:
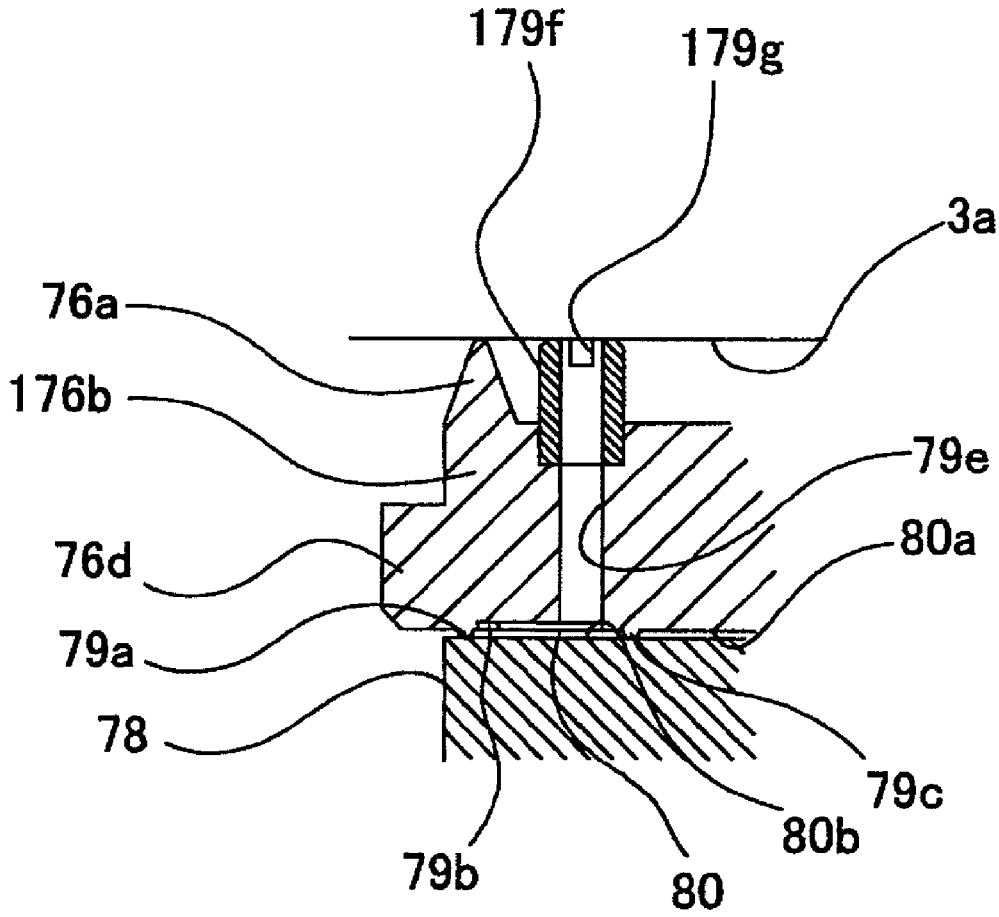
FIG. 12 is a cross-sectional view corresponding to FIG. 9 in an ink-jet printer as a modification of the embodiment of the present invention.

There will be explained a modification of the embodiment of the present invention. In the above-described embodiment, the contact body 79*f* is formed integrally with the bottom plate portion 76*b*, but, as shown in FIG. 12, a contact body 179*f* may be formed by a material having higher stiffness than a bottom plate portion 176*b* (for example, rigid resin). In this case, it is preferable that the contact body 179*f* is fitted in a hole formed in a surrounding of the through hole 79*e* of the bottom plate portion 176*b*. According to this modification, in the capping operation, the connecting portion 79*c* opposed to the contact body 179*f* can be pressed to the front surface 80*b* of the holder 78 at a higher pressure. Further, in the above-described embodiment, the pair of wall bodies 79*a* are formed such that the respective wall bodies thereof are parallel to each other, but the present invention is not limited to this construction. For example, the pair of wall bodies 79*a* may be formed such that the respective wall bodies thereof are not parallel to each other, and may be formed such that the respective wall bodies thereof are formed independently of each other so as to have respective lengths different from each other. Further, the two wall bodies and the connecting portion 79*c* may be connected to each other without any joint or seam and may be formed in a circular shape by curved lines (portions) or a combination of straight lines (portions) and curved lines (portions) so as to enclose the ink-ejection area.

It is to be understood that the present invention is not limited to the details of the illustrated embodiment, but may be embodied with various changes and modifications, which may occur to those skilled in the art, without departing from the spirit and scope of the present invention. For example, in the above-described embodiment, the pair of wall bodies 79*a*, the groove 79*b*, the connecting portions 79*c*, 79*d*, and the dummy wall bodies 76*f* are formed integrally with the bottom plate portion 76*b*, but at least a portion of the pair of wall bodies 79*a*, the groove 79*b*, the connecting portions 79*c*, 79*d*, and the dummy wall bodies 76*f* may be formed integrally with the holder. Further, at least a portion of the pair of wall bodies 79*a*, the connecting portions 79*c*, 79*d*, and the dummy wall bodies 76*f* may be formed as an independent member.

Further, in the above-described embodiment, the dummy wall bodies 76*f* are formed on all the area of the back surface 80*a* of the bottom plate portion 76*b* in which the pair of wall bodies 79*a* are not formed and which is included in the area of the back surface 80*a* opposed to the portion of the circular projection 76*a* that extends in the longitudinal direction thereof, but at least a portion of the dummy wall bodies 76*f* may not be formed on the area of the back surface 80*a* opposed to the portion of the circular projection 76*a*. Where the holder is formed by the material having the higher stiffness than the bottom plate portion and where the wall bodies 79*a* and the dummy wall bodies 76*f* are formed on the relatively soft bottom plate portion side, the wall bodies 79*a* and the dummy wall bodies 76*f* are pressed or crushed by the holder to closely contact with the holder. On the other hand, where the wall bodies 79*a* and the dummy wall bodies 76*f* are formed on the relatively stiff holder side, the wall bodies 79*a* and the dummy wall bodies 76*f* closely contact with the bottom portion so as to press or crush the bottom plate portion.

Further, in the above-described embodiment, the contact body 79*f* is provided upright on the bottom surface of the recessed portion 76*c*, but the ink-jet printer 1 may be configured such that the contact body 79*f* is not provided upright. From the viewpoint of preventing the clogging of the ink of the through hole 79*e*, one of openings of the through hole 79*a* nearer to the recessed portion 76*c* is preferably disposed at a position higher than the bottom surface.

Further, in the above-described embodiment, the present invention is applied to the ink-jet printer 1, and the head cap unit constituted by the tray 75 and the four caps 76 is incorporated into the maintenance unit 70, but only the maintenance unit or the head cap unit may be independent. In this case, the head cap unit may have one, two, three, or more than or equal to five cap(s) 76.

What is claimed is:

1. A head cap, comprising:

a cap having a substantially rectangular shape in plan view and comprising (a) a bottom plate portion and (b) a circular projecting portion which functions as a side wall, which projects from the bottom plate portion, and which comprises a distal end configured to contact a surrounding of a liquid-droplets ejecting area formed in a liquid-droplets ejecting surface of a liquid-droplets ejecting head, such that the liquid-droplets ejecting area is enclosed thereby;

a recessed portion defined by at least an inner wall of the circular projecting portion and an upper surface of the bottom plate portion, the recessed portion configured to become a closed space defined by at least the liquid-droplets ejecting surface, the inner wall of the circular projecting portion, and the upper surface of the bottom plate portion, when the distal end of the projecting portion is brought into contact with the liquid-droplets ejecting surface;

a holder configured to support the cap;

a groove formed in at least one of a first surface of the bottom plate portion which is opposed to the holder and a second surface of the holder which is opposed to the bottom plate portion so as to partly constitute an air communicating channel that enables fluid communication between the closed space and a space external to the closed space; and a channel wall provided between the first surface and the second surface so as to enclose the groove as seen in a direction perpendicular to one of the first surface and the second surface by contacting with at least one of the first surface and the second surface, wherein the channel wall comprises a pair of wall bodies which extend in a longitudinal direction of the cap in one side end portion of the cap and which are formed on the bottom plate portion so as to be superposed on the circular projecting portion in plan view, the groove being interposed between the pair of wall bodies.

2. The head cap according to claim 1, wherein the channel wall comprises a connecting portion configured to connect the pair of wall bodies to each other.

3. The head cap according to claim 2, wherein the groove communicates at one end thereof with a through hole that is formed through the cap to enable fluid communication with the closed space, and the groove communicates at another end thereof with a through hole that is formed through the holder to enable fluid communication with a space external to the closed space and to the holder, and wherein the connecting portion is configured to connect the pair of wall bodies to each other at the one end and the other end of the groove such that the pair of wall bodies and the connecting portion enclose an entire perimeter of the groove in plan view.

4. The head cap according to claim 2, wherein the connecting portion has the same height as the pair of wall bodies.

5. The head cap according to claim 2, further comprising a pair of dummy wall bodies, which extend in the longitudinal direction of the cap while being interposed between the bottom plate portion and the holder in another side end portion of the cap, and which are formed on the bottom plate portion so as to be superposed on the projecting portion in plan view, wherein each of the pair of dummy wall bodies has the same height as the channel wall, and wherein a groove is formed between the pair of dummy wall bodies to not communicate with an outside when each dummy wall body of the pair of dummy wall bodies is in contact with the holder.

6. The head cap according to claim 5, wherein the pair of dummy wall bodies is disposed so as to be symmetrical with the pair of wall bodies about a center line extending in a longitudinal direction of the bottom plate portion.

7. The head cap according to claim 5, wherein the pair of wall bodies and the pair of dummy wall bodies extend so as to be parallel to each other, and wherein the pair of wall bodies and the pair of dummy wall bodies are disposed such that a perpendicular line extending through the distal end of the projecting portion in a direction perpendicular to at least one of the first surface and the second surface is interposed between at least one pair of the pair of wall bodies and the pair of dummy wall bodies.

8. The head cap according to claim 7, wherein at least a portion of the pair of wall bodies extends to a position at which the perpendicular line extending through the distal end of the projecting portion is not interposed between the respective two wall bodies of the pair of wall bodies, and wherein the groove extends to the position of the pair of wall bodies at which the through hole communicated with the recessed portion is formed.

9. The head cap according to claim 1, wherein the channel wall is configured to be connected to one of the first surface and the second surface.

10. The head cap according to claim 1, wherein the channel wall is formed integrally with the bottom plate portion.

11. The head cap according to claim 1, wherein the groove is formed in only one of the first surface and the second surface to which the channel wall is connected.

12. The head cap according to claim 1, wherein a surface of an end of the channel wall which contacts with at least one of the first surface and the second surface is provided by a curved surface having a convex shape.

13. The head cap according to claim 1, wherein in the bottom plate portion a through hole is formed through the first surface from a bottom surface of the recessed portion so as to be communicated with the groove;

wherein the head cap further comprises a hollow contact body provided upright in the recessed portion so as to be communicated with an opening of the through hole in the recessed portion; and wherein when the projecting portion contacts with the liquid-droplets ejecting surface, a distal end portion of the contact body contacts with an area of the liquid-droplets ejecting surface other than the liquid-droplets ejecting area.

14. The head cap according to claim 13, wherein the contact body is formed integrally with the bottom plate portion.

15. The head cap according to claim 13, wherein the contact body is formed of a material having higher stiffness than the bottom plate portion.

16. A head cap, comprising:

a cap comprising (a) a bottom plate portion and (b) a projecting portion which functions as a side wall, which extends from the bottom plate portion so as to define a recessed portion with the bottom plate portion, and whose distal end contacts with a surrounding of a liquid-droplets ejecting area formed in a liquid-droplets ejecting surface of a liquid-droplets ejecting head so as to enclose the liquid-droplets ejecting area;

a holder configured to support the cap;

a groove formed in at least one of a first surface of the bottom plate portion which is opposed to the holder and a second surface of the holder which is opposed to the bottom plate portion so as to partly constitute an air communicating channel that communicates the recessed portion and an outside with each other; and a channel wall provided between the first surface and the second surface so as to enclose the groove as seen in a direction perpendicular to one of the first surface and the second surface by contacting with at least one of the first surface and the second surface, wherein the channel wall comprises:

a pair of wall bodies extending so as to interpose the groove therebetween; and a connecting portion configured to connect the pair of wall bodies to each other;

wherein in the bottom plate portion a through hole is formed through the first surface from a bottom surface of the recessed portion so as to be communicated with the groove;

wherein the head cap further comprises a hollow contact body provided upright in the recessed portion so as to be communicated with an opening of the through hole in the recessed portion;

wherein when the projecting portion contacts with the liquid-droplets ejecting surface, a distal end portion of the contact body contacts with an area of the liquid-droplets ejecting surface other than the liquid-droplets ejecting area; and wherein at least a portion of the pair of wall bodies and the connecting portion is disposed so as to be superposed on the contact body enclosing the through hole, in a direction perpendicular to one of the first surface and the second surface.

17. A head cap, comprising:

a cap having a substantially rectangular shape in plan view and comprising (a) a bottom plate portion and (b) a circular lip portion which functions as a side wall, which is provided upright on the bottom plate portion so as to define a recessed portion with the bottom plate portion, and whose distal end contacts with a surrounding of a nozzle surface of an inkjet head so as to enclose a plurality of nozzles formed in the nozzle surface when contacting with the nozzle surface;

a holder configured to support the cap;

a pair of wall bodies which extend in a longitudinal direction of the cap while being interposed between the bottom plate portion and the holder in one of side end portions of the cap in a widthwise direction thereof and which are formed on the bottom plate portion so as to be superposed on the lip portion in plan view;

a pair of dummy wall bodies which extend in the longitudinal direction of the cap while being interposed between the bottom plate portion and the holder in the other of the side end portions of the cap in the widthwise direction thereof and which are formed on the bottom plate portion so as to be superposed on the lip portion in plan view;

a groove which extends while being interposed between the pair of wall bodies and communicates the recessed portion and an outside with each other via a through hole formed in the bottom plate portion; and a connecting portion configured to connect the pair of wall bodies to each other, wherein the groove is formed in the bottom plate portion and an entire perimeter of the groove is enclosed with the pair of wall bodies and the connecting portion in plan view.

18. The head cap according to claim 17, further comprising a contact body having a hollow cylindrical shape and provided upright on the bottom plate portion in the recessed portion so as to be communicated with an opening of the through hole, wherein when the lip portion contacts with the nozzle surface, a distal end portion of the contact body contacts with an area of the nozzle surface other than an area thereof in which the plurality of nozzles are formed.

19. A liquid-droplets-ejection-head recovering mechanism configured to perform a recovering operation for recovering a liquid-droplets-ejection property of a liquid-droplets ejection head, the mechanism comprising:

a head cap configured to contact a liquid-droplets ejecting surface of the liquid-droplets ejection head such that a liquid-droplets ejecting area of the liquid-droplets ejecting head is covered by the head cap;

a raising and lowering mechanism configured to move the head cap relative to the liquid-droplets ejecting head between a contact position at which the head cap contacts with the liquid-droplets ejecting surface and a distant position distant from the liquid-droplets ejecting surface in a vertical direction; and a moving mechanism configured to move the head cap relative to the liquid-droplets ejecting head between an opposed position opposed to the liquid-droplets ejecting head and a retracted position distant from the opposed position in a direction intersecting the vertical direction, wherein the head cap comprises:

a cap having a substantially rectangular shape in plan view and comprising (a) a bottom plate portion and (b) a projecting portion which functions as a side wall, which extends from the bottom plate portion, and which comprises a distal end configured to contact a surrounding of the liquid-droplets ejecting area, such that the liquid-droplets ejecting area is enclosed thereby;

a recessed portion defined by an inner wall of the projecting portion and an upper surface of the bottom plate portion, the recessed portion configured to become a closed space defined by the liquid-droplets ejecting surface, the inner wall of the projecting portion, and the upper surface of the bottom plate portion, when the distal end of the projecting portion is brought into contact with the liquid-droplets ejecting surface;

a holder configured to support the cap;

a pair of wall bodies disposed so as to extend in an area opposed to the projecting portion while being interposed between the bottom plate portion and the holder;

a groove extending while being interposed between the pair of wall bodies so as to constitute an air communicating channel that enables fluid communication between the closed space and a space external to the closed space; and a connecting portion configured to connect the pair of wall bodies to each other, wherein the groove is formed in at least one of a first surface of the bottom plate portion and a second surface of the holder, and is enclosed with the pair of wall bodies and the connecting portion as seen in a direction perpendicular to one of the first surface and the second surface, and wherein the pair of wall bodies extend in a longitudinal direction of the cap in one side end portion of the cap, the pair of wall bodies being formed on the bottom plate portion so as to be superposed on the projecting portion in plan view, the groove being interposed between the pair of wall bodies.

20. A liquid-droplets ejection printer comprising:

a sheet feeding mechanism configured to feed a recording medium in a sheet feeding direction;

a liquid-droplets ejecting head having a liquid-droplets ejecting surface in which a liquid-droplets ejecting area for ejecting a liquid is formed and configured to form an image on the recording medium fed by the sheet feeding mechanism; and a recovering mechanism configured to perform a recovering operation for recovering a liquid-droplets-ejection property of the liquid-droplets ejection head, the mechanism comprising:

a head cap configured to contact the liquid-droplets ejecting, surface such that the liquid-droplets ejecting area is covered by the head cap;

a raising and lowering mechanism configured to move the head cap relative to the liquid-droplets ejecting head between a contact position at which the head cap contacts with the liquid-droplets ejecting surface and a distant position distant from the liquid-droplets ejecting surface in a vertical direction; and a moving mechanism configured to move the head cap relative to the liquid-droplets ejecting head between an opposed position opposed to the liquid-droplets ejecting head and a retracted position distant from the opposed position in a direction intersecting the vertical direction, wherein the head cap comprises:

a cap having a substantially rectangular shape in plan view and comprising (a) a bottom plate portion and (b) a projecting portion which functions as a side wall, which extends from the bottom plate portion, and which comprises a distal end configured to contact a surrounding of the liquid-droplets ejecting area, such that the liquid-droplets ejecting area is enclosed thereby;

a recessed portion defined by an inner wall of the projecting portion and an upper surface of the bottom plate portion, the recessed portion configured to become a closed space defined by the liquid-droplets ejecting surface, the inner wall of the projecting portion, and the upper surface of the bottom plate portion, when the distal end of the projecting portion is brought into contact with the liquid-droplets ejecting surface;

a holder configured to support the cap;

a pair of wall bodies disposed so as to extend in an area opposed to the projecting portion while being interposed between the bottom plate portion and the holder;

a groove extending while being interposed between the pair of wall bodies so as to constitute an air communicating channel that enables fluid communication between the closed space and a space external to the closed space; and a connecting portion configured to connect the pair of wall bodies to each other, wherein the groove is formed in at least one of a first surface of the bottom plate portion and a second surface of the holder, and is enclosed with the pair of wall bodies and the connecting portion as seen in a direction perpendicular to one of the first surface and the second surface, and wherein the pair of wall bodies extend in a longitudinal direction of the cap in one side end portion of the cap, the pair of wall bodies being formed on the bottom plate portion so as to be superposed on the projecting portion in plan view, the groove being interposed between the pair of wall bodies.

* * * * *